US010955792B2

(12) United States Patent
Matsushita et al.

(10) Patent No.: US 10,955,792 B2
(45) Date of Patent: Mar. 23, 2021

(54) PROCESS CARTRIDGE INCLUDING PHOTOSENSITIVE MEMBER HAVING MULTIPLE GROOVES AND IMAGE FORMING APPARATUS INCLUDING THE PROCESS CARTRIDGE

(71) Applicant: CANON KABUSHIKI KAISHA, Tokyo (JP)

(72) Inventors: Shunsuke Matsushita, Yokohama (JP); Yoshihiro Mitsui, Numazu (JP); Yasukazu Ikami, Tokyo (JP); Shinichi Hagiwara, Tokyo (JP); Kosuke Ikada, Machida (JP); Katsuyuki Nonaka, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/677,918

(22) Filed: Nov. 8, 2019

(65) Prior Publication Data

US 2020/0150583 A1 May 14, 2020

(30) Foreign Application Priority Data

Nov. 14, 2018 (JP) ..... JP2018-213923
Dec. 28, 2018 (JP) ..... JP2018-247084

(51) Int. Cl.
*G03G 21/00* (2006.01)
*G03G 21/18* (2006.01)
*G03G 15/00* (2006.01)

(52) U.S. Cl.
CPC ..... *G03G 21/1814* (2013.01); *G03G 15/751* (2013.01); *G03G 21/0011* (2013.01)

(58) Field of Classification Search
CPC .. G03G 21/1814; G03G 15/75; G03G 15/751; G03G 21/0011; G03G 21/0017; G03G 21/0029; G03G 21/18
See application file for complete search history.

(56) References Cited

U.S. PATENT DOCUMENTS 7,186,489 B2 3/2007 Uematsu
9,778,583 B2 10/2017 Terauchi
(Continued)

FOREIGN PATENT DOCUMENTS

JP S63101855 A 5/1988
JP 2005241736 A 9/2005
(Continued)

*Primary Examiner* — Walter L Lindsay, Jr.
*Assistant Examiner* — Laura Roth
(74) *Attorney, Agent, or Firm* — Rossi, Kimms & McDowell LLP

(57) ABSTRACT

A process cartridge includes a developing device that supplies developer to a photosensitive member and an elastic portion that cleans a peripheral surface of the photosensitive member. Multiple grooves are formed side by side in a generatrix direction on the peripheral surface. The developer contains a toner including a toner particle and an organosilicon polymer having a structure represented by R—$SiO_{3/2}$ covering the toner particle surface, where R represents a hydrocarbon group having at least 1 and not more than 6 carbon atoms. When a penetration amount of the elastic portion with respect to the photosensitive member is set as δ (mm), and a fixing rate of the organosilicon polymer on the surface of the toner particle is set as α (%), $\delta \leq 0.02 \times \alpha - 0.4$ is satisfied.

19 Claims, 13 Drawing Sheets

(56) References Cited

U.S. PATENT DOCUMENTS

| | | | | |
|---|---|---|---|---|
| 9,904,195 | B2 | 2/2018 | Matsui | |
| 2006/0008717 | A1* | 1/2006 | Uematsu | G03G 5/00 430/56 |
| 2013/0170856 | A1* | 7/2013 | Takahashi | G03G 15/751 399/111 |
| 2015/0177653 | A1* | 6/2015 | Seki | G03G 15/161 399/101 |
| 2016/0319077 | A1* | 11/2016 | Ishizu | G03G 9/09725 |
| 2019/0187609 | A1* | 6/2019 | Ikami | G03G 21/0011 |
| 2020/0150552 | A1* | 5/2020 | Shindo | G03G 15/1685 |
| 2020/0150553 | A1* | 5/2020 | Agata | G03G 9/08773 |
| 2020/0150555 | A1* | 5/2020 | Ikada | G03G 15/065 |
| 2020/0150556 | A1* | 5/2020 | Oka | G03G 9/00 |
| 2020/0150557 | A1* | 5/2020 | Kihara | G03G 15/0808 |
| 2020/0150558 | A1* | 5/2020 | Oka | G03G 15/0812 |
| 2020/0150578 | A1* | 5/2020 | Yamauchi | G03G 5/06 |
| 2020/0150584 | A1* | 5/2020 | Hagiwara | G03G 5/1473 |

FOREIGN PATENT DOCUMENTS

| | | | |
|---|---|---|---|
| JP | 4027407 | B2 | 12/2007 |
| JP | 2010019990 | A | 1/2010 |
| JP | 2016038591 | A | 3/2016 |
| JP | 2016085271 | A | 5/2016 |
| JP | 2016194619 | A | 11/2016 |
| JP | 2017134386 | A | 8/2017 |
| JP | 2017138590 | A | 8/2017 |

* cited by examiner

A-A CROSS SECTION

θ=100 DEGREES

PROCESS CARTRIDGE INCLUDING PHOTOSENSITIVE MEMBER HAVING MULTIPLE GROOVES AND IMAGE FORMING APPARATUS INCLUDING THE PROCESS CARTRIDGE

BACKGROUND OF THE INVENTION

Field of the Invention

The present invention relates to a technology for mounting a process cartridge that is detachable from an electrophotographic system or electrostatic recording system image forming apparatus.

Description of the Related Art

In electrophotographic image forming apparatuses, reducing the sizes of apparatuses is required. When power required for driving a photosensitive drum and an intermediate transfer belt can be reduced, the sizes of apparatuses can be reduced by reducing the size of a drive device.

In a mono-component contact development system image forming apparatus using an intermediate transfer belt system, a development roller, a toner sealing member, an intermediate transfer belt, and a charging member, which are development members, are constantly or intermittently in contact with a photosensitive drum. In addition, in order to remove a toner remaining on the photosensitive drum after a transfer step, a cleaning device is provided. In consideration of simplicity of the configuration and toner removal performance, a counter system configuration in which a cleaning blade made of an elastic body (elastic portion) is brought into contact with a photosensitive drum in a counter direction with respect to a rotation direction of the photosensitive drum is widely used for a cleaning device.

In counter system blade cleaning, the cleaning blade is strongly brought into contact with and rubbed against a photosensitive drum. Therefore, most of the torque generated in the photosensitive drum is consumed in the cleaning device. Therefore, reduction in torque in this part greatly contributes to reducing the size of the image forming apparatus.

Japanese Patent No. 4027407 proposes a technology in which, in order to reduce a torque in a blade cleaning, multiple grooves that extend substantially in a circumferential direction are formed on the peripheral surface of a photosensitive drum, and a contact area between the photosensitive drum and a cleaning blade is reduced.

SUMMARY OF THE INVENTION

However, the technology described in Japanese Patent No. 4027407 has the following problems. Inorganic silica, which is a general toner external additive, is inserted into a contact region (hereinafter referred to as a "cleaning nip") between the photosensitive drum and the cleaning blade, and the inorganic silica has a polishing effect. Therefore, during long-term use, there is a possibility of the grooves formed on the peripheral surface of the photosensitive drum being preferentially polished to reduce a torque due to the polishing effect of silica. As a result, there is a possibility of a contact area between the photosensitive drum and the cleaning blade increasing, a driving torque of the photosensitive drum increasing, and power consumption increasing.

The present invention provides a process cartridge that can realize a low torque during long-term use and reduce power consumption.

In order to achieve the object described above, a process cartridge used for an image forming apparatus, including:

a rotatable photosensitive member having a peripheral surface on which a latent image is formed;

a developing device configured to supply a developer to the photosensitive member for developing the latent image on the photosensitive member; and a plate-shaped elastic portion that comes in contact with the peripheral surface of the photosensitive member and cleans the peripheral surface, wherein, in the photosensitive member, multiple grooves extend in a circumferential direction on the peripheral surface and are formed to be side by side in a rotation axis direction on the peripheral surface, the developer supplied from the developing device to the photosensitive member contains a toner including a toner particle and an organosilicon polymer having a structure represented by a following Formula (1) covering the surface of the toner particle, and when a penetration amount of the plate-shaped elastic portion with respect to the photosensitive member is set as $\delta$ (mm), and a fixing rate of the organosilicon polymer on the surface of the toner particle is set as $\alpha$ (%), a following Formula (2) is satisfied:

$$R—SiO_{3/2} \quad (1)$$

(R represents a hydrocarbon group having at least 1 and not more than 6 carbon atoms)

$$\delta \leq 0.02 \times \alpha - 0.4 \quad (2).$$

In order to achieve the object described above, a process cartridge used for an image forming apparatus, including:

a rotatable photosensitive member having a peripheral surface on which a latent image is formed; and a developing device configured to supply a developer to the photosensitive member for developing the latent image on the photosensitive member; and a plate-shaped elastic portion that comes in contact with the peripheral surface of the photosensitive member and cleans the peripheral surface, wherein, in the photosensitive member, multiple grooves extend in a circumferential direction on the peripheral surface and are formed to be side by side in a rotation axis direction on the peripheral surface, the developer supplied from the developing device to the photosensitive member contains a toner including a toner particle and a particle containing an organosilicon polymer having a structure represented by a following Formula (1) presents on the surface of the toner particle, and when a penetration amount of the plate-shaped elastic portion with respect to the photosensitive member is set as $\delta$ (mm), and a fixing rate of the particle on the surface of the toner particle is set as $\alpha$ (%), a following Formula (2) is satisfied:

$$R—SiO_{3/2} \quad (1)$$

(R represents a hydrocarbon group having at least 1 and not more than 6 carbon atoms)

$$\delta \leq 0.02 \times \alpha - 0.4 \quad (2)$$

In order to achieve the object described above, an image forming apparatus according to an embodiment, including:

an apparatus main body; and the process cartridge according to the embodiment which is detachable from and attachable to the apparatus main body.

According to the present invention, it is possible to realize a low torque during long-term use in the process cartridge and reduce power consumption.

Further features of the present invention will become apparent from the following description of exemplary embodiments with reference to the attached drawings.

DESCRIPTION OF THE EMBODIMENTS

Forms for implementing the present invention will be exemplified below in detail based on embodiments with reference to the drawings. However, sizes, materials, shapes, and relative arrangements of elements described in examples can be appropriately changed according to the configuration of an apparatus to which the invention is applied and various conditions. That is, there is no intention to limit the scope of the invention to the following examples.

Here, in examples, the statement "at least XX and not more than XX" and "XX to XX" indicating a numerical range refer to a numerical range including the lower limit and the upper limit which are end points unless otherwise noted.

Embodiment 1

<1-1> Overall Schematic Configuration of Image Forming Apparatus

Figure 1:
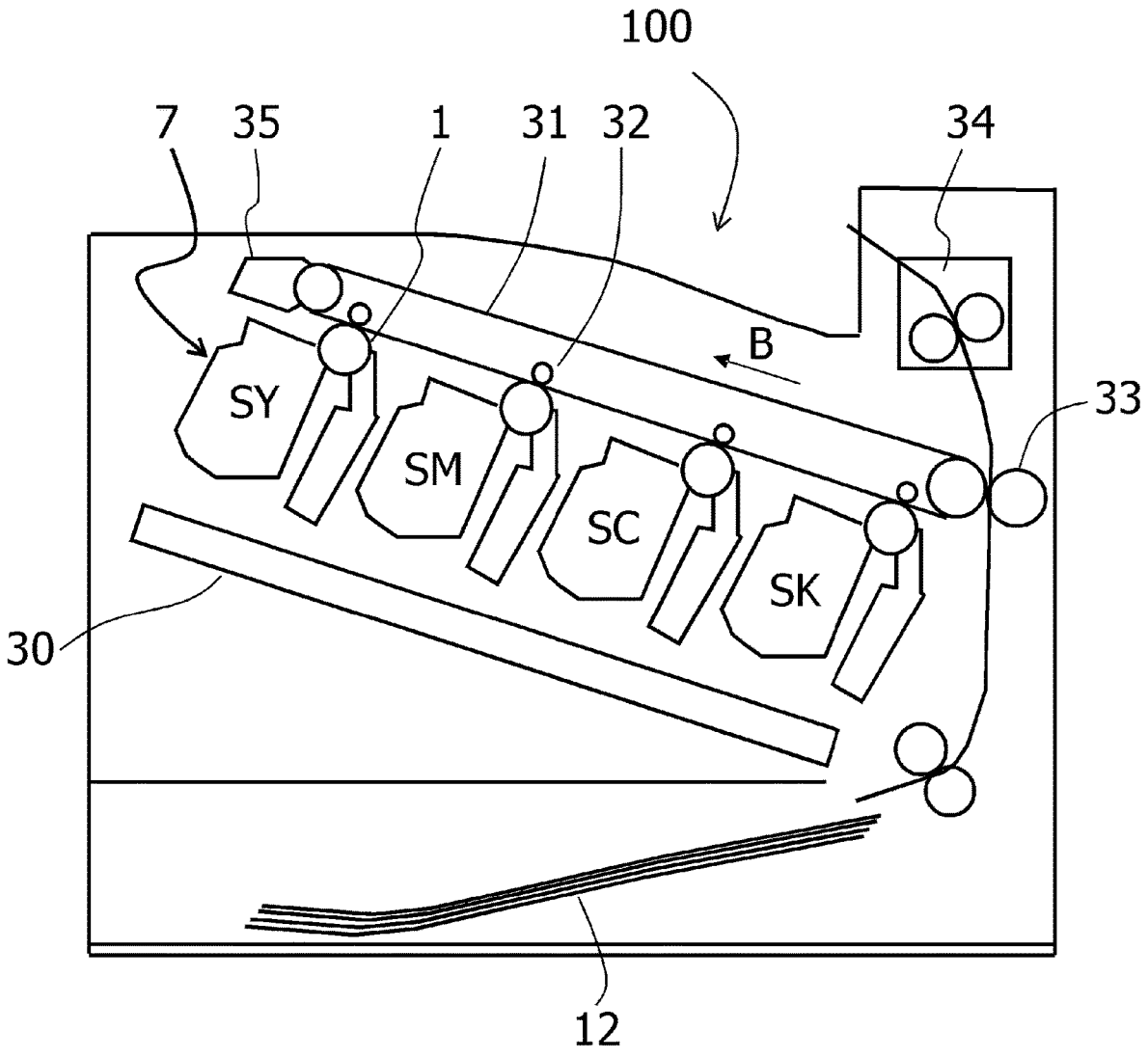
FIG. 1 is a schematic cross-sectional view of an image forming apparatus according to an embodiment.

An overall configuration of an electrophotographic image forming apparatus (image forming apparatus) of the present embodiment will be described. FIG. 1 is a schematic cross-sectional view of an image forming apparatus 100 of the present embodiment. Examples of an image forming apparatus to which the present embodiment can be applied include a copier and a printer using an electrophotographic system, and a case in which the present invention is applied to a laser printer will be described here. The image forming apparatus 100 of the present embodiment is a full-color laser printer using an in-line system and an intermediate transfer system. The image forming apparatus 100 can form a full-color image on a recording member (for example, recording paper, plastic sheet, cloth, etc.) according to image information. The image information is input to an image forming apparatus main body 100 from an image reading device connected to the image forming apparatus 100 or a host device such as a personal computer that is communicatively connected to an image forming apparatus main body 100A.

The image forming apparatus 100 includes, as a plurality of image forming units, first, second, third, and fourth image forming units SY, SM, SC, and SK for forming images of respective colors of yellow (Y), magenta (M), cyan (C), and black (K). In the present embodiment, the first to fourth image forming units SY, SM, SC, and SK are disposed in a line in a direction intersecting the vertical direction.

Here, in the present embodiment, the configurations and operations of the first to fourth image forming units SY, SM, SC, and SK are substantially the same except that colors of images to be formed are different from each other. Therefore, unless there is a particular distinction below, subscripts Y, M, C, and K that are added to the reference numerals in order to indicate that they are elements provided for certain colors will be omitted and the units will be generally described.

In the present embodiment, the image forming apparatus 100 includes, as a plurality of image bearing members, four drum type electrophotographic photosensitive members provided by side by side in a direction intersecting the vertical direction, that is, a photosensitive drum 1. The photosensitive drum 1 as an image bearing member that carries an electrostatic latent image is driven to rotate by a driving unit (not shown). A scanner unit (exposure device) 30 as an exposure unit that emits a laser beam based on image information and forms an electrostatic image (electrostatic latent image) on the photosensitive drum 1 is disposed in the image forming apparatus 100. In addition, in the image forming apparatus 100, an intermediate transfer belt 31 as an intermediate transfer member for transferring a toner image on the photosensitive drum 1 to a recording member 12 is disposed so that it faces the four photosensitive drums 1. The intermediate transfer belt 31 formed in an endless belt as the intermediate transfer member comes in contact with all of the photosensitive drums 1, and circulates (rotates) in a direction indicated by the arrow B in the drawing (counterclockwise).

On the inner peripheral surface side of the intermediate transfer belt 31, four primary transfer rollers 32 as primary transfer units are provided side by side so that they face the photosensitive drums 1. Thus, a voltage having a polarity opposite to the normal charging polarity of the toner is applied to the primary transfer roller 32 from a primary transfer bias power supply as a primary transfer bias applying unit (not shown). Therefore, the toner image on the photosensitive drum 1 is transferred (primary transfer) onto the intermediate transfer belt 31.

In addition, on the outer peripheral surface side of the intermediate transfer belt 31, a secondary transfer roller 33 as a secondary transfer unit is disposed. Thus, a voltage having a polarity opposite to the normal charging polarity of the toner is applied to the secondary transfer roller 33 from a secondary transfer bias power supply as a secondary transfer bias applying unit (not shown). Therefore, the toner image on the intermediate transfer belt 31 is transferred (secondary transfer) to the recording member 12. For example, when a full-color image is formed, the above processes are sequentially performed in the image forming units SY, SM, SC, and SK, and toner images of colors are superimposed and sequentially primary-transferred to the intermediate transfer belt 31. Then, the recording member 12 is conveyed to the secondary transfer unit in synchronization with movement of the intermediate transfer belt 31. Then, 4-color toner images on the intermediate transfer belt 31 are secondary-transferred onto the recording member 12 together due to the action of the secondary transfer roller 33 in contact with the intermediate transfer belt 31 via the recording member 12.

The toner 10 that is not transferred to the recording member 12 by the secondary transfer roller 33 but remains on the intermediate transfer belt 31 is conveyed to a cleaning device 35 for an intermediate transfer member and removed.

The recording member 12 to which the toner image is transferred is conveyed to a fixing apparatus 34. The toner image is fixed to the recording member 12 by applying heat or a pressure to the recording member 12 in the fixing apparatus 34.

In the present embodiment, the photosensitive drum 1, and a charging roller 2, a developing roller 4, a cleaning blade 8, and the like to be described below as processing units acting on the photosensitive drum 1 are integrated, that is, formed into an integrated cartridge, to form a process cartridge 7.

<1-2> Schematic Configuration of Process Cartridge

Figure 2:
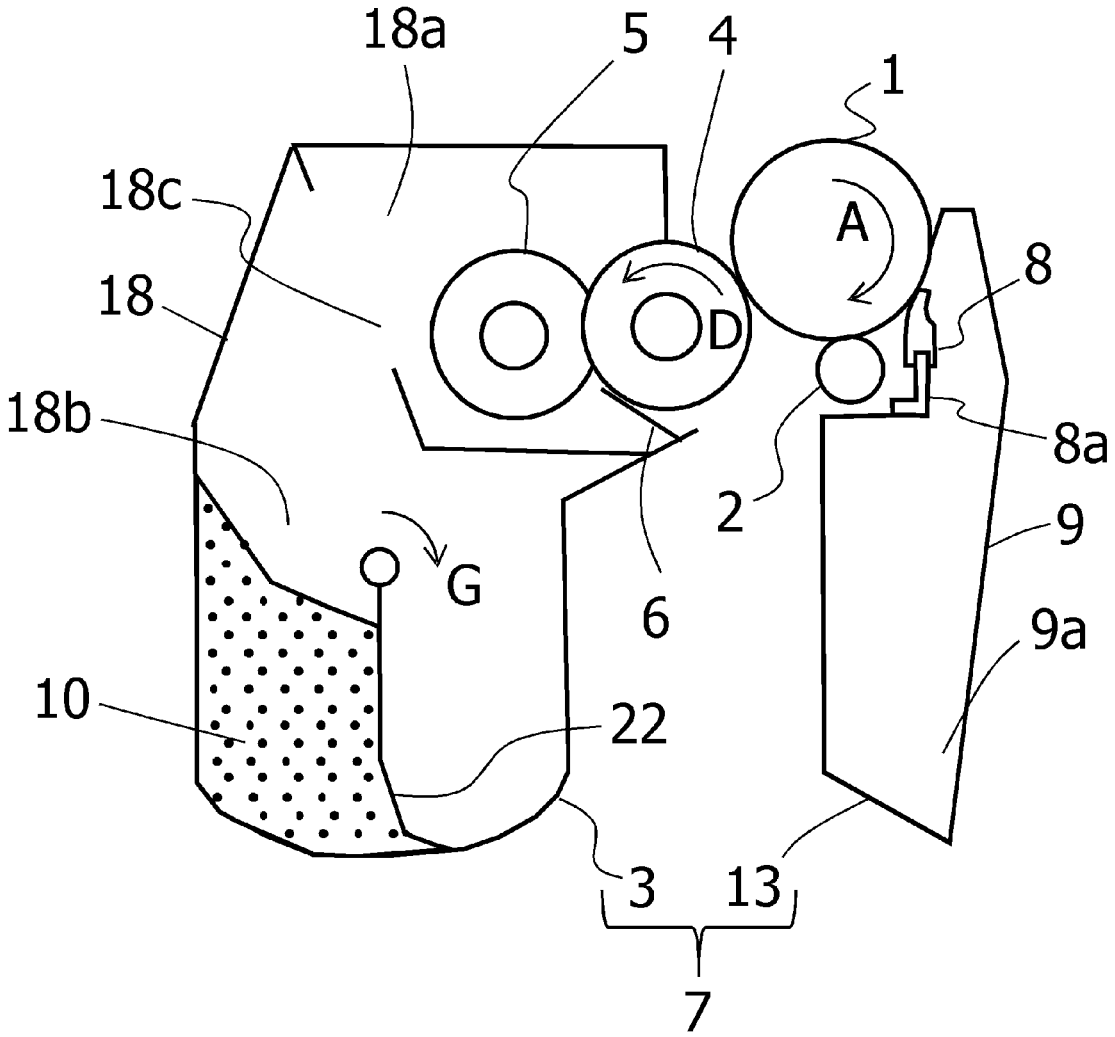
FIG. 2 is a schematic cross-sectional view of a process cartridge according to the embodiment.

An overall configuration of the process cartridge 7 mounted in the image forming apparatus 100 of the present embodiment will be described. FIG. 2 is a cross-sectional (main cross-sectional) view of the process cartridge 7 of the present embodiment when viewed in a longitudinal direction (rotation axis direction) of the photosensitive drum 1. The process cartridge 7 is detachable from the image forming apparatus 100 via a mounting unit such as a mounting guide and a positioning member provided in the body of the image forming apparatus 100. In the present embodiment, process cartridges 7 for respective colors have the same shape, and toners 10 for yellow (Y), magenta (M), cyan (C), and black (K) colors are stored in the process cartridges 7 for respective colors. A case in which all of the process cartridges 7 are detachable from the image forming apparatus 100 has been described in the present embodiment, but the present invention is not limited to such a configuration. For example, a configuration in which, in the process cartridges 7, a development apparatus 3 to be described below is independently detachable from the image forming apparatus (separated from a photosensitive member unit 13 to be described below) may be used.

Here, in the present embodiment, the configurations and operations of the process cartridges 7 for respective colors are substantially the same except for the type (color) of the toner 10 stored therein.

The process cartridge 7 includes the development apparatus 3 including the developing roller 4 and the like and the photosensitive member unit 13 including the photosensitive drum 1.

The development apparatus 3 includes the developing roller 4, a toner supply roller 5, a toner transport member 22, and a developing frame body 18 that rotatably supports them. The developing frame body 18 includes a developing chamber 18*a* in which the developing roller 4 and the toner supply roller 5 are disposed and a toner storage chamber (developing agent storage chamber) 18*b* in which the toner 10 is stored. The developing chamber 18*a* and the toner storage chamber 18*b* communicate with each other through an opening 18*c*.

In the toner storage chamber 18*b*, the toner transport member 22 for conveying this toner 10 to the developing chamber 18*a* is provided, and the toner 10 is conveyed to the developing chamber 18*a* according to rotation in a direction indicated by the arrow G in the drawing.

In the developing chamber 18*a*, the developing roller 4 as a toner carrying member (developing agent carrying member) that is in contact with the photosensitive drum 1 and rotates in a direction indicated by the arrow D in the drawing is provided. In the present embodiment, the developing roller 4 and the photosensitive drum 1 rotate so that surfaces at the facing portion (contact portion) move in the same direction, that is, rotation directions are opposite to each other.

In addition, a toner supply roller (hereinafter referred to as a "supply roller") 5 as a toner supply member that supplies the toner 10 conveyed from the toner storage chamber 18*b* to the developing roller 4 is disposed inside the developing chamber 18*a*. In addition, a toner amount control member 6 that regulates a coating amount of the toner 10 on the developing roller 4 supplied by the supply roller 5 and applies charging is disposed inside the developing chamber 18*a*.

Voltages are independently applied to the developing roller 4, the supply roller 5, and the toner amount control member 6 from a high pressure power supply. The toner 10 supplied to the developing roller 4 by the supply roller 5 is triboelectrically charged due to rubbing between the developing roller 4 and the regulating member 6, and the layer thickness is regulated at the same time as charging is applied. The regulated toner 10 on the developing roller 4 is conveyed to a portion facing the photosensitive drum 1 according to rotation of the developing roller 4, and the electrostatic latent image on the photosensitive drum 1 (on the photosensitive member) is developed and visualized as a toner image (a developer image).

On the other hand, the photosensitive member unit 13 includes a cleaning frame body 9 as a frame body that supports various elements in the photosensitive member unit 13 of the photosensitive drum 1 and the like. The photosensitive drum 1 is rotatably attached to the cleaning frame body 9 via a bearing (not shown). The photosensitive drum 1 receives a driving force of a drive motor provided in a device main body of the image forming apparatus 100 and is driven to rotate in a direction indicated by the arrow A in the drawing.

In addition, in the photosensitive member unit 13, the charging roller 2, and the cleaning blade 8 as a plate-shaped elastic body (plate-shaped elastic portion) are disposed so that they come in contact with the peripheral surface of the photosensitive drum 1. A voltage is applied to a metal core of the charging roller 2 from a high pressure power supply (not shown), and the surface of the photosensitive drum 1 is charged to a predetermined voltage. The cleaning blade 8 of which one end is fixed to a metal sheet 8*a* as a plate-shaped support member (plate-shaped support portion) and of which the other end as a free end comes in contact with the photosensitive drum 1 forms a contact region (hereinafter referred to as a "cleaning nip") with the photosensitive drum 1.

The metal sheet 8*a* is fixed to the cleaning frame body 9. In the metal sheet 8*a*, one end is fixed to the cleaning frame body 9, and the cleaning blade 8 is fixed to the other end as a free end. In the metal sheet 8*a*, one plate part bent in an L-shape is fixed to the cleaning frame body 9 by a fastener such as a screw, and the other plate part extends in a direction substantially orthogonal to the one plate part, and the cleaning blade 8 is fixed to the tip (refer to FIG. 2). The metal sheet 8*a* (the other plate part) and the cleaning blade 8 extend together in substantially the same direction from the fixed end (one plate part) of the metal sheet 8*a*. The extending direction is a direction (reverse direction) opposite to the rotation direction of the photosensitive drum 1 at a portion where the tip (the other end) of the cleaning blade 8 is in contact on the peripheral surface of the photosensitive drum 1. The direction in which the metal sheet 8*a* and the cleaning blade 8 extend is a downward direction. The rotation direction of the photosensitive drum 1 is a direction in which a portion where the tip (the other end) of the cleaning blade 8 is in contact on the peripheral surface of the photosensitive drum 1 moves in a downward direction.

Here, an orientation of the process cartridge 7 in FIG. 2 is an orientation when it is mounted (used) in an image forming apparatus main body. In this specification, when the positional relationship and direction and the like of members of the process cartridge are described, the positional relationship and direction and the like in this orientation are shown. That is, in FIG. 2, the up to down direction in the drawing corresponds to the vertical direction, and the left to right direction in the drawing corresponds to the horizontal direction. Here, this disposition configuration is set on the assumption that the image forming apparatus is installed on a horizontal plane in a normal installation state.

When the cleaning blade 8 rubs against the peripheral surface of the photosensitive drum 1, the occurrence of image problems caused when the toner 10 and fine particles remaining from the transfer step are scraped off from the photosensitive drum 1, and the residual toner and the like contaminate the charging roller 2, and move around the photosensitive drum 1 is prevented. In addition, the cleaning blade 8 removes discharge products adhered to the surface of the photosensitive drum 1 in the charging step and prevents friction of the photosensitive drum 1 from increasing. The toner 10 removed from the surface of the photosensitive drum 1 by the cleaning blade 8 falls into and is stored in a waste toner storage chamber 9*a* provided below the cleaning blade 8 in the cleaning frame body 9.

Here, the inventors of this application have found that the following points are important in order to realize a low torque during long-term use in the cleaning device of the process cartridge. Specifically, particles having low friction are inserted into the cleaning nip and kept therein according to application of a sufficient pressure.

When the surface of the toner particles is covered with a specific organosilicon polymer, surface free energy can be reduced so that low friction can be exhibited.

Toner particles having low friction allow grooves formed on the peripheral surface of the photosensitive drum 1 to be maintained and allow a contact area between the photosensitive drum 1 and the cleaning blade 8 to remain small during long-term use. Thereby, it is possible to realize a low torque during long-term use and reduce power consumption. A more specific configuration of the process cartridge of the present embodiment will be described below in detail.

<1-3> Description of Cleaning Blade

The cleaning blade 8 used in the present embodiment is produced using the method described in the example in Japanese Patent Application Publication No. 2017-134386. The cleaning blade 8 uses a rubber member of such as a urethane rubber and a silicon rubber that is fixed to the metal sheet 8*a* as a plate-shaped metal support member. Then, the dynamic hardness H of the tip part in contact with the photosensitive drum 1 is set to $0.1\ (mN/\mu m^2) \leq H \leq 0.4\ (mN/\mu m^2)$. When the dynamic hardness H of the tip part is larger than 0.4, since the hardness of the surface is too large, edge chipping may occur. In addition, when the dynamic hardness H is less than 0.1, even if the internal hardness near the surface is large, a contact width (an area of the contact region) becomes too wide, the peak pressure (a contact pressure per unit area of the contact region (pressure obtained by dividing the contact pressure by the area of the contact region)) decreases, and cleaning performance may decrease. In the cleaning blade 8 having such characteristics, the surface layer of the urethane rubber may be cured. The cleaning blade 8 of which the surface is cured has a small amount of deformation when it is brought into contact with the photosensitive drum 1, and has a nip width with the photosensitive drum 1, which does not widen, and thus the maximum value of the contact pressure is high, and an increase in torque can be minimized while an excellent ability to prevent slipping through can be exhibited.

Method of Measuring Hardness of Cleaning Blade

Using a "Shimadzu Dynamic Micro Hardness Tester DUH-W211S" (commercially available from Shimadzu Corporation), using the method disclosed in Japanese Patent Application Publication No. 2017-134386, the hardness of the cleaning blade 8 near the contact edge with the photosensitive drum 1 is measured. Regarding an indenter, a 115° triangular pyramid indenter is used, and the dynamic hardness is obtained using the following calculation formula.

$$\text{Dynamic hardness } H = \alpha \times P/D^2$$

Here, P: load (mN), D: depth of the indenter pushed into the sample (μm), α: constant depending on the shape of the indenter.

Here, measurement conditions are as follows.

α: 3.8584

P: 1.0 mN

Load speed: 0.03 mN/sec

Retention time: 5 seconds

Measurement environment: temperature of 23° C., relative humidity of 55%

Aging of measurement sample: being left under an environment of a temperature of 23° C. and a relative humidity of 55% for 6 hours or longer <1-4> Description of Photosensitive Member Drum The photosensitive drum 1 in the present embodiment is produced according to the production method described in Japanese Patent No. 4027407. The photosensitive drum 1 includes a cylindrical metal support having conductivity, a conductive layer as an undercoat layer of the support, a photosensitive layer (charge generation layer, charge transport layer) formed on the undercoat layer, and a protective layer formed on the photosensitive layer.

Roughening Treatment on Photosensitive Member Drum

The photosensitive drum 1 of the present embodiment is subjected to a roughening treatment for polishing the surface of the photosensitive drum 1 in order to reduce a contact area with the cleaning blade 8 and reduce a driving torque of the photosensitive drum 1. According to Japanese Patent No. 4027407, multiple grooves extend in a substantially circumferential direction (peripheral direction) on the peripheral surface of photosensitive drum 1 and are formed to be side by side in the longitudinal direction (generatrix direction) of the photosensitive drum 1, and a width of the grooves is within a range of at least 0.5 μm and not more than 40 μm.

Figure 7:
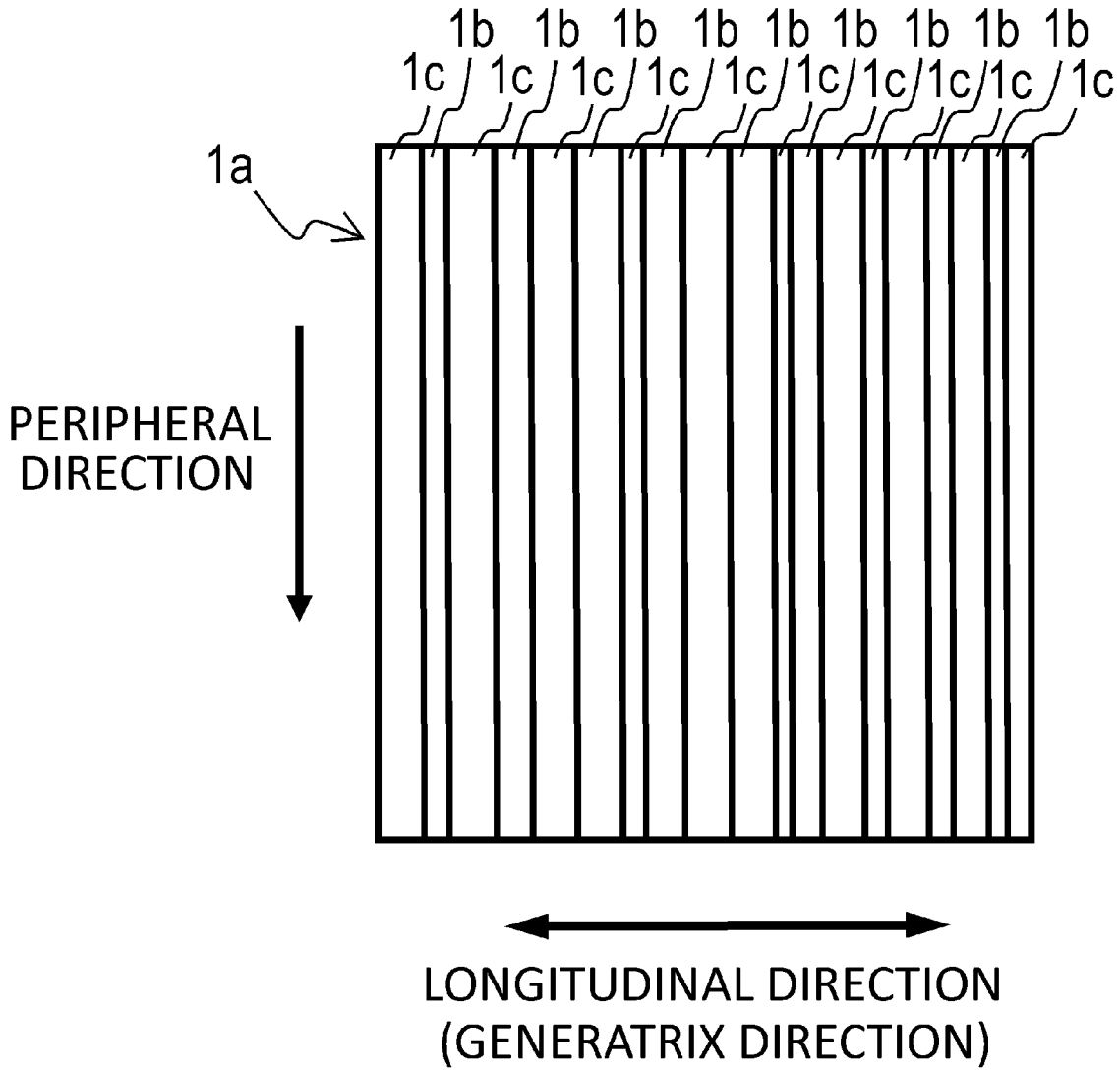
FIG. 7 is a schematic view showing a form example of the peripheral surface of the photosensitive drum in the embodiment.

FIG. 7 shows an example of a state of grooves 1*b* formed on a peripheral surface 1*a* of the photosensitive drum 1. As shown in FIG. 7, the grooves 1*b* are annular grooves that extend in the circumferential direction on the peripheral surface 1*a* of the photosensitive drum 1, and are arranged at intervals in the generatrix direction of the peripheral surface 1*a*. That is, the peripheral surface 1*a* has a configuration in which flat parts 1*c* in which no grooves 1*b* are formed and the grooves 1*b* are alternately formed in the generatrix direction. Here, a region in which the grooves 1*b* are formed on the peripheral surface 1*a* need only include at least a region with which the cleaning blade 8 comes in contact, and is not necessarily formed over the entire peripheral surface 1*a* in the longitudinal direction. Therefore, the description related to the proportion of the number of grooves 1*b* with respect to the peripheral surface 1*a* described here is a description focusing on only a range of a region in which the grooves 1*b* and the flat parts 1*c* are provided on the peripheral surface 1*a*. For example, in a region that is not in contact with the cleaning blade 8 such as both ends of the peripheral surface 1*a* in the longitudinal direction, that is, a region in which the grooves 1*b* are not provided (not required), the proportion of the number of grooves 1*b* and the like are not included in items that specify the present embodiment, and not a subject of discussion here.

In Japanese Patent No. 4027407, the number of grooves 1*b* is desirably at least 20 and not more than 1000 per 1000 μm in the width of the peripheral surface 1*a* in the generatrix direction. In the embodiment, a width of the grooves in a generatrix direction of the peripheral surface 1*a* is within a range of at least 0.5 μm and not more than 40 μm and the number of grooves is at least 20 and not more than 1000 per a length of 1000 μm of the peripheral surface 1*a* in the generatrix direction. Hereinafter, the number of grooves 1*b* having a width within a range of at least 0.5 μm and not more than 40 μm per a length of 1000 μm of the peripheral surface 1*a* in the generatrix direction will be referred to as a "groove density," that is, in the above case, the groove density is at least 20 and not more than 1000.

Here, as described in Japanese Patent No. 4027407, the present invention is not limited to the configuration in which the grooves 1*b* are formed to extend in the same direction as in the circumferential direction as shown in FIG. 7. For example, a configuration in which the grooves 1*b* are formed with an angle of 10° with respect to the circumferential direction may be used. In addition, a configuration in which the grooves 1*b* are formed with an angle of ±30° with respect to the circumferential direction may be used or a configuration in which the grooves 1*b* having different angles cross each other may be used. In the present embodiment, "substantially circumferential direction" includes a completely circumferential direction and a substantially circumferential direction, and the substantially circumferential direction specifically refers to a direction of less than ±60° with respect to the circumferential direction.

When the groove density is less than 20, the edge part of the cleaning blade 8 may be chipped due to an increase in the number of sheets that pass, faulty cleaning may occur, a black stripe image is likely to be formed on an output image, and fusion of a toner or the like occurs, and a white dotted image is likely to be formed on the output image.

On the other hand, when the groove density exceeds 1000, character reproducibility deteriorates, a small letter (for example, a character of 3 points or less) image is difficult to reproduce and may be blurred or faulty cleaning in which the toner slips through the cleaning blade particularly in a low humidity environment may occur.

In addition, grooves with a width of larger than 40 μm tend to cause uneven shades or a white scratch image on a halftone image and also tend to cause a black scratch image on a white background image. Therefore, the proportion of grooves with a width of larger than 40 μm among grooves formed on the peripheral surface of the photosensitive drum 1 is preferably 20% or less with respect to all of the grooves formed on the peripheral surface of the photosensitive drum 1.

In addition, a width of a part (the flat part 1*c*; refer to FIG. 7) in the longitudinal direction between a groove 1*b* and a groove 1*b* which extend substantially in the circumferential direction of the peripheral surface 1*a* of the photosensitive drum 1 in the present embodiment is preferably at least 0.5 μm and not more than 40 μm.

If the width of the flat part 1*c* exceeds 40 when this is used in an electrophotographic device in which a cleaning unit having a cleaning blade is mounted, a torque between the photosensitive drum 1 and the cleaning blade is likely to increase, and faulty cleaning is likely to occur.

In addition, on the peripheral surface 1*a* of the photosensitive drum 1, multiple grooves 1*b* are formed to be side by side in a rotation axis direction on the photosensitive drum 1 and extend in the circumferential direction on the peripheral surface, when the number of grooves 1*b* having the width within the range of at least 0.5 μm and not more than 40 μm is i (20≤i≤1000) per the length of 1000 μm of the peripheral surface 1*a* in the generatrix direction (that is, the groove density is i), and widths of the i grooves 1*b* having the width within the range of at least 0.5 μm and not more than 40 μm are set as $W_1$ to $W_i$ [μm], it is preferable that the following relational expression (a) be satisfied.

$$200 \leq \sum_{n=1}^{i} Wn \leq 800 \quad \text{(a)}$$

The relational expression (a) means that a total width (hereinafter referred to as "ΣWn") of grooves having the width within the range of at least 0.5 μm and not more than 40 μm of i grooves is at least 200 μm and not more than 800 μm.

If the total width of grooves exceeds 800 μm, when this is used in an electrophotographic device in which a cleaning unit having a cleaning blade is mounted, faulty cleaning due to toner slip-through between the electrophotographic photosensitive member and the cleaning blade is likely to occur. On the other hand, when the total width of grooves is smaller than 200 μm, a torque between the electrophotographic photosensitive member and the cleaning blade is likely to increase and faulty cleaning due to blade vibration (oscillating) and tuck-up is likely to occur.

In the present embodiment, the widths and the groove density of grooves formed on the peripheral surface of the photosensitive drum 1, and the width of the flat part are measured as follows using a non-contact 3D surface measuring machine Micromap 557N (commercially available from Ryoka Systems Inc.).

First, a 5× two-beam interference objective lens is mounted on an optical microscope section of the Micromap, an electrophotographic photosensitive member is fixed under the lens, and regarding a surface shape image, an interference image is vertically scanned using a CCD camera in a Wave mode to obtain a 3D image. The range of the obtained image is 1.6 mm×1.2 mm.

Next, the obtained 3D image is analyzed, and the number of grooves per unit length of 1000 μm and the width of the grooves are obtained as data. Based on this data, it is possible to analyze the width of the grooves and the number of grooves.

Here, in the present embodiment, the number of grooves with a width of 0.5 μm or more is counted, and in 3 parts of the electrophotographic photosensitive member in the generatrix direction, 4 parts each in the respective parts in the circumferential direction are measurement parts (a total of 12 parts).

In addition, regarding the width of grooves and the number of grooves, in addition to a Micromap, using commercially available laser microscopes (ultra-depth profile measuring microscopes VK-8550 and VK-9000, commercially available from Keyence Corporation), a scanning type confocal laser microscope OLS3000 (commercially available from Olympus Corporation), a Real Color Confocal Microscope OPTELICS C130 (commercially available from Lasertec Corporation)), and digital microscopes VHX-100 and VH-8000 (commercially available from Keyence Corporation), or the like, an image of the peripheral surface of the electrophotographic photosensitive member is obtained, and the width of grooves and the number of grooves can be obtained based on the image using image processing software (for example, WinROOF (commercially available from Mitani Corporation). In addition, when a 3D non-contact shape measuring device (NewView 5032 (commercially available from Zygo Corporation)) or the like is used, measurement can be performed in the same manner as in a Micromap.

In addition, based on JIS standard 1982, the ten-point average surface roughness Rz of the peripheral surface of the photosensitive drum 1 is preferably at least 0.3 μm and not more than 1.3 When the ten-point average surface roughness Rz is smaller than 0.3 an image smearing eliminating effect may be diminished, and when the ten-point average surface roughness Rz exceeds 1.3 character reproducibility deteriorates, and a small letter (for example, a character of 3 points or less) image is difficult to reproduce and may be blurred.

In addition, in the present embodiment, based on JIS standard 1982, the difference (R max−Rz) between the maximum surface roughness R max and the ten-point average surface roughness Rz of the peripheral surface of the electrophotographic photosensitive member is preferably at least 0.0 μm and not more than 0.3 μm and more preferably at least 0.0 μm and not more than 0.2 When the difference exceeds 0.3 uneven shades may occur on the halftone image.

In the present embodiment, the ten-point average surface roughness Rz and the maximum surface roughness R max of the peripheral surface of the electrophotographic photosensitive member are measured based on JIS standard 1982 using a surface roughness measurement instrument Surfcorder SE3500 type (commercially available from Kosaka Laboratory Ltd.) under the following conditions.

Detector: R2 μm 0.7 mN diamond needle

Filter: 2CR

Cut-off value: 0.8 mm

Measurement length: 2.5 mm

Feeding speed: 0.1 mm

Here, in the present embodiment, in 3 parts of the electrophotographic photosensitive member in the generatrix direction, 4 parts each in the respective parts in the circumferential direction are measurement parts (a total of 12 parts).

Therefore, in the present embodiment, the same roughening treatment as that described in Japanese Patent No. 4027407 is also performed.

Figure 3:
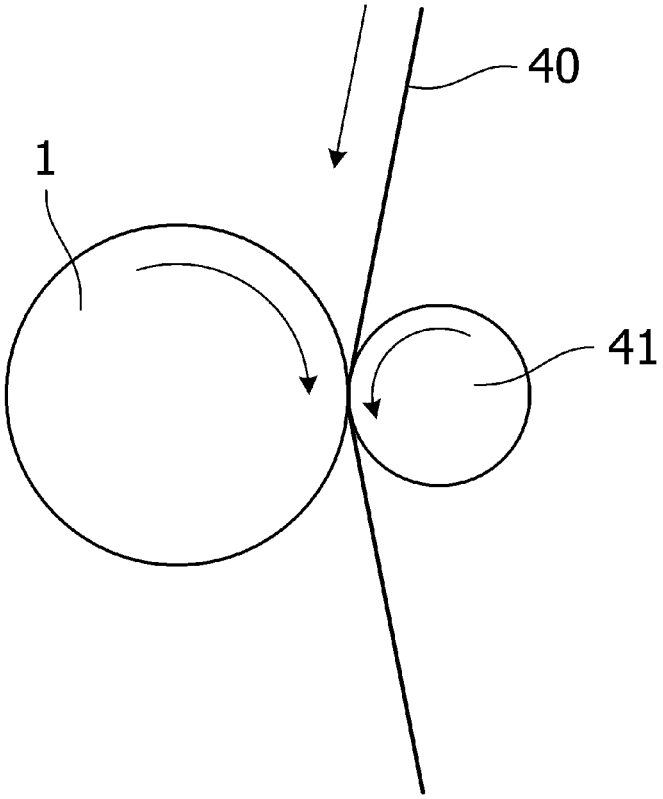
FIG. 3 is a schematic view of a polishing device for polishing a surface of a photosensitive drum in the embodiment.

FIG. 3 is a schematic view of a polishing device for polishing the surface of the photosensitive drum 1. Regarding a disposition, a polishing sheet 40 is interposed between the photosensitive drum 1 and a backup roller 41 so that a polishing surface of the polishing sheet 40 is pressed against the surface of the photosensitive drum 1. In such a disposition, the photosensitive drum 1 and the backup roller 41 rotate in opposite directions so that they move in the same direction at a nip part into which the polishing sheet 40 is inserted. In addition, the polishing sheet 40 is wound by a winding mechanism (not shown) so that it moves in the same direction as the direction in which the photosensitive drum 1 and the backup roller 41 move in the nip part.

Regarding polishing conditions, a polishing sheet (product name: GC #3000, base layer sheet thickness: 75 μm, commercially available from Riken Corundum Co., Ltd.) is used as the polishing sheet 40. In addition, a urethane roller (outer diameter: 50 mm) having a hardness of 20° is used as the backup roller 41. A penetration amount (inroad amount) of the backup roller 41 with respect to the photosensitive drum 1 via the polishing sheet 40 is set to 2.5 mm, a sheet feed amount is set to 400 mm/s, a feed direction of the polishing sheet 40 is made the same as a rotation direction of the photosensitive drum 1, and polishing is performed for 30 seconds.

The surface roughness of the photosensitive drum 1 after polishing is measured using a surface roughness measuring machine (product name: SE700, SMB-9, commercially available from Kosaka Laboratory Ltd.) under the following conditions.

In the longitudinal direction of the photosensitive drum 1, measurement is performed at positions of 30, 110, and 185 mm from the upper end of coating, and forward rotation of 120° is performed, and in the same manner, measurement is then performed at positions of 30, 110, and 185 mm from the upper end of coating. In addition, forward rotation of 120° is performed and in the same manner, measurement is then performed, and measurement is performed at a total of 9 points. The average value is Rz=0.45 μm according to JIS B0601-2001 standard. Measurement conditions are as follows: measurement length: 2.5 mm, cut-off value: 0.8 mm, feeding speed: 0.1 mm/s, filter characteristics: 2CR, and leveling: straight line (the entire region).

In addition, the other parameters are as follows.

(R max−Rz): 0.2 μm

The number of grooves having a width within a range of at least 0.5 μm and not more than 40 μm per a length of 1000 μm of the peripheral surface in the generatrix direction: 400

"ΣWn": 350 μm

According to the roughening treatment, it is possible to produce the photosensitive drum 1 having multiple grooves substantially in the circumferential direction of the peripheral surface of the photosensitive drum 1 which can reduce a contact area with the cleaning blade 8.

Elastic Deformation Ratio and Universal Hardness Value (HU) of Circumferential Surface of Photosensitive Member Drum In the present embodiment, the universal hardness value (HU) of the peripheral surface of the photosensitive drum is preferably 150 $N/mm^2$ or more and more preferably 160 $N/mm^2$ or more. In order to prevent the peripheral surface of the photosensitive drum from being worn and scratched, in the present embodiment, the universal hardness value (HU) of the peripheral surface of the electrophotographic photosensitive member is 210 $N/mm^2$ or less, and more preferably 200 $N/mm^2$ or less.

For example, the universal hardness value (HU) is preferably at least 150 $N/mm^2$ and not more than 210 $N/mm^2$.

In addition, in the present embodiment, the elastic deformation ratio of the peripheral surface of the photosensitive drum is preferably at least 50% and not more than 65%.

When the universal hardness value (HU) is too large or when the elastic deformation ratio is too small, since an elastic force on the surface of the photosensitive drum is insufficient, the paper dust and toner interposed between the peripheral surface of the photosensitive drum and the cleaning blade rub the peripheral surface of the photosensitive drum. Therefore, the surface of the photosensitive drum is likely to be scratched and is likely to be worn accordingly. In addition, when the universal hardness value (HU) is too large, even if the elastic deformation ratio is high, an amount of elastic deformation becomes small. As a result, a high pressure is applied to a local area of the surface of the photosensitive drum, and thus deep scratches are likely to occur on the surface of the electrophotographic photosensitive member.

In addition, even if the universal hardness value (HU) is within the above range, when the elastic deformation ratio is too small, since an amount of plastic deformation becomes relatively large, fine scratches are likely to occur on the surface of the electrophotographic photosensitive member, and wear is likely to occur. This is especially noticeable not only when the elastic deformation ratio is too small but also when the universal hardness value (HU) is too small.

In the present embodiment, the universal hardness value (HU) and the elastic deformation ratio of the peripheral surface of the electrophotographic photosensitive member are values measured under a 25° C./50% RH environment using a microhardness measuring device FISCHERSCOPE H100V (commercially available from Fischer). This FISCHERSCOPE H100V is a device that brings an indenter into contact with a subject to be measured (the peripheral surface of the electrophotographic photosensitive member), continuously applies a load to the indenter, directly reads the indentation depth under the load and thus obtains a continuous hardness.

A Vicker rectangular pyramid diamond indenter with a facing angle of 136° is used as the indenter, the indenter is pressed against the peripheral surface of the electrophotographic photosensitive member, the last load (final load) continuously applied to the indenter is 6 mN, and a time for which a state in which a final load of 6 mN is applied to the indenter is maintained (retention time) is 0.1 seconds. In addition, the number of measurement points is 273.

The universal hardness value (HU) can be obtained from the indentation depth of the indenter when a final load of 6 mN is applied to the indenter according to the following formula. Here, in the following formula, HU indicates a universal hardness value (HU), Ff indicates a final load, Sf indicates a surface area of an indented part of the indenter when the final load is applied, and hf indicates the indentation depth of the indenter when the final load is applied.

$$HU=Ff[N]/Sf[mm^2]=(6\times10^{-3})/[26.43\times(hf\times10^{-3})^2] \quad \text{(Formula)}$$

Specific measurement methods of the above universal hardness value (HU) and elastic deformation ratio are the same as the methods described in Japanese Patent No. 4027407.

In addition, a specific forming method of a surface layer of the photosensitive drum for obtaining the photosensitive drum having a universal hardness value (HU) and elastic deformation ratio of the peripheral surface within the above ranges is the same as the method described in Japanese Patent No. 4027407. That is, a surface layer of a photosensitive member is formed by curing and polymerizing (polymerization with cross-linking) a hole transport compound having a chain polymerizable functional group, and particularly, it is effective to form a surface layer by curing and polymerizing a hole transport compound having two or more chain polymerizable functional groups in the same molecule. In addition, when a hole transport compound having a sequentially polymerizable functional group is used, the compound is preferably a hole transport compound having three or more sequentially polymerizable functional groups in the same molecule.

Here, the elastic deformation ratio of the peripheral surface of the photosensitive drum used in the present embodiment is 60%, and the universal hardness value (HU) is 180 $N/mm^2$.

Figure 4:
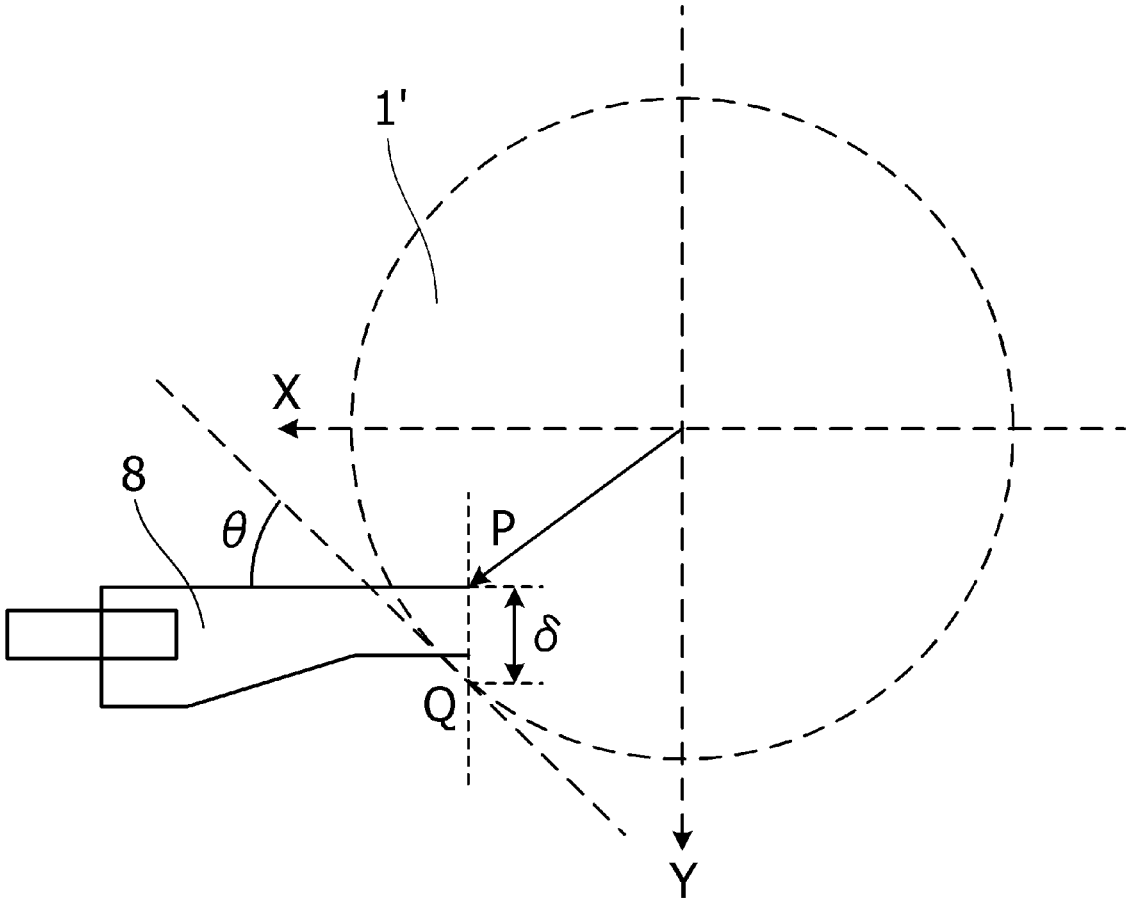
FIG. 4 is a schematic illustration diagram of a penetration amount and a setting angle in the embodiment.

<1-5> Description of Penetration Level and Setting Angle with Respect to Photosensitive Member Drum A penetration amount δ and a setting angle θ of the cleaning blade 8 with respect to the photosensitive drum 1 of the present embodiment will be described. FIG. 4 is a schematic view showing the penetration amount δ and the setting angle θ in the present embodiment.

As shown in FIG. 4, in a cross section perpendicular to the axis of the photosensitive drum 1, each disposition relationship is considered based on coordinates in which the rotation center axis of the photosensitive drum 1 is the origin, and a direction parallel to the direction in which the cleaning blade 8 (the metal sheet 8*a*) extends is set as an X axis and a direction perpendicular to the X axis is set as a Y axis.

In the coordinate system, the rotation direction of the photosensitive drum 1 is clockwise, and the cleaning blade 8 is positioned in the third quadrant and is disposed so that it approaches the photosensitive drum 1 from a position away therefrom in the X axis direction. As shown in FIG. 4, the cleaning blade 8 and the photosensitive drum 1 are virtually disposed without considering deformation of them, and a tip part of the cleaning blade 8 overlaps a virtual photosensitive drum 1'. In the actual contact state, the tip of the cleaning blade 8 is bent and deformed along the peripheral surface of the photosensitive drum 1, and the tip side on the surface facing the peripheral surface of the photosensitive drum 1 in the cleaning blade 8 comes in contact with the peripheral surface of the photosensitive drum 1. The tip part (corner between the contact surface and the tip surface) of the surface in contact with the photosensitive drum 1 of the cleaning blade 8 is set as a tip P. Here, in the present embodiment, since the tip part of the cleaning blade 8 has a rectangular cross section, the corner is the tip P. However, for example, in a configuration in which the corner has a round cross section, the tip P does not necessarily match the corner. That is, in the actual contact state, the boundary end on the tip side of the contact surface is the tip P. The intersection between the straight line that passes through the tip P and extends downward in the Y axis direction with respect to the surface in contact with the photosensitive drum 1 in the cleaning blade 8 and the virtual photosensitive drum 1' is set as an intersection Q, and a distance between the tip P and the intersection Q is set as a penetration amount δ. In addition, an angle formed by the tangent of the virtual photosensitive drum 1' with the intersection Q as a contact point and the surface in contact with the photosensitive drum 1 in the cleaning blade 8 is set as a setting angle θ.

<1-6> Toner

The toner of the present embodiment is a toner including toner particles (a toner particle) and an organosilicon polymer having a structure represented by Formula (1) that covers the surface of the toner particles.

When the surface of toner particles was covered with organosilicon polymers having a structure represented by Formula (1), the toner particles had the surface layer which was a layer present on the outmost surface of the toner particles. That is, the toner particles had a surface layer containing organosilicon polymers having a structure represented by Formula (1).

The surface layer was very hard compared to conventional toner particles. Therefore, in consideration of fixing performance, a part in which no surface layer was formed on a part of the surface of toner particles was preferably provided.

However, the proportion of the number of division axes in which the thickness of the surface layer containing organosilicon polymers was 2.5 nm or less (hereinafter, the proportion of the surface layer with a thickness of 2.5 nm or less) was preferably 20.0% or less. This condition approximated the case in which at least 80.0% or more of the surface of toner particles was formed of a surface layer containing organosilicon polymers of 2.5 nm or more. That is, when this condition was satisfied, the surface layer containing organosilicon polymers sufficiently covered the surface of toner particles. 10.0% or less was more preferable. Although measurement was performed according to observation of the cross section using a transmission electron microscope (TEM), details will be described below.

Organosilicon Polymer Having Structure Represented by Formula (1)

The toner includes toner particles and an organosilicon polymer covering the surface of the toner particles, the organosilicon polymer having a structure represented by Formula (1):

$$R—SiO_{3/2} \quad (1)$$

wherein R represents a hydrocarbon group having at least 1 and not more than 6 carbon atoms.

In the organosilicon polymer having a structure represented by Formula (1), one of four valences of Si atoms is bonded to R and the remaining three valences are bonded to 0 atoms. 0 atoms form a state in which two valences both are bonded to Si, that is, a siloxane bond (Si—O—Si).

In consideration of Si atoms and O atoms in the organosilicon polymer, since three O atoms are provided with respect to two Si atoms, it is represented by $—SiO_{3/2}$.

In addition, in the chart obtained by $^{29}$Si-NMR measurement of a tetrahydrofuran (THF) insoluble matter of toner particles, the proportion of the peak area ascribed to the structure of Formula (1) to the entire peak area of the organosilicon polymers is preferably 20% or more. Although a detailed measurement method will be described below, this approximates the case in which a substructure represented by $R—SiO_{3/2}$ has a proportion of 20% or more in the organosilicon polymer contained in toner particles.

As described above, among four valences of Si atoms, three valences are bonded to oxygen atoms, and these oxygen atoms are bonded to other Si atoms, which represents a structure of $—SiO_{3/2}$. If one oxygen atom among them is of a silanol group, the structure of the organosilicon polymer is represented by $R—SiO_{2/2}—OH$. In addition, when two oxygen atoms are of a silanol group, its structure is $R—SiO_{1/2}(—OH)_2$. Comparing these structures, a structure in which a larger number of oxygen atoms form a cross-linked structure together with Si atoms is closer to a silica structure represented by $SiO_2$. Therefore, when the number of frameworks of $—SiO_{3/2}$ increases, since it is possible to lower a surface free energy of the surface of toner particles, excellent environmental stability and anti-member contamination effects are obtained.

In addition, due to durability of the structure represented by Formula (1) and hydrophobicity and charging performance of R in Formula (1), bleeding of a low-molecular-weight (Mw: 1000 or less) resin and a low glass transition temperature (Tg: 40° C. or lower) resin which are present further inside than the surface layer and easily outmigrated is reduced. In some cases, bleeding of the release agent is also reduced.

It is possible to control the proportion of the peak area of the structure represented by Formula (1) according to the type and amount of the organosilicon compound used to form the organosilicon polymer and also the reaction temperature, the reaction time, the reaction solvent and pH for hydrolysis, addition polymerization and condensation polymerization when the organosilicon polymer is formed.

In the structure represented by Formula (1), R represents a hydrocarbon group having at least 1 and not more than 6 carbon atoms. Therefore, a charge quantity tends to be stable. In particular, an alkyl group or phenyl group having at least 1 and not more than 6 carbon atoms having excellent environmental stability is preferable.

In the present embodiment, R is more preferably an aliphatic hydrocarbon group having at least 1 and not more than 3 carbon atoms in order to further improve charging performance and fogging prevention. When charging performance is favorable, since transferability is favorable and an amount of the residual transfer toner is small, contamination of the drum, the charging member and the transfer member is reduced.

Preferable examples of an aliphatic hydrocarbon group having at least 1 and not more than 3 carbon atoms include a methyl group, an ethyl group, a propyl group, and a vinyl group. In consideration of environmental stability and storage stability, R is more preferably a methyl group.

Regarding an organosilicon polymer production example, a sol-gel method is preferable. The sol-gel method is a method in which a liquid raw material is used as a starting material and subjected to hydrolysis and condensation polymerization and gelled from a sol state, and is used as a method of synthesizing glass, ceramics, organic-inorganic hybrids, and nanocomposites. When this production method is used, it is possible to produce functional materials with various shapes such as the surface layer, fibers, bulk bodies, and fine particles at a low temperature from a liquid phase.

Specifically, the organosilicon polymer having a structure represented by Formula (1) is preferably generated according to hydrolysis and condensation polymerization of a silicon compound represented by an alkoxysilane.

When the surface of toner particles is covered with the organosilicon polymer, it is possible to obtain a toner having improved environmental stability, and in which reduction in toner performance during long-term use is unlikely to occur, and having excellent storage stability.

In addition, the sol-gel method begins with a liquid, the liquid is gelled to form a material, and thus various micro structures and shapes can be formed. In particular, when toner particles are produced in the aqueous medium, they are easily precipitated on the surface of toner particles due to hydrophilicity of a hydrophilic group such as a silanol group of the organosilicon compound. The micro structure and shape can be adjusted according to the reaction temperature, the reaction time, the reaction solvent, and pH and the type and amount of the organometallic compound and the like.

The organosilicon polymer is preferably a condensation polymerization product of an organosilicon compound having a structure represented by the following Formula (Z).

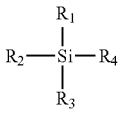

(Z)

(in Formula (Z), $R_1$ represents a hydrocarbon group having at least 1 and not more than 6 carbon atoms, and $R_2$, $R_3$ and $R_4$ each independently represent a halogen atom, a hydroxy group, an acetoxy group, or an alkoxy group.)

According to a hydrocarbon group (preferably an alkyl group) for $R_1$, it is possible to improve hydrophobicity and it is possible to obtain toner particles having excellent environmental stability. In addition, regarding a hydrocarbon group, an aryl group which is an aromatic hydrocarbon group, for example, a phenyl group, can be used. When hydrophobicity of $R_1$ is large, a charge amount variation tends to increase in various environments. Therefore, in consideration of environmental stability, $R_1$ is preferably an aliphatic hydrocarbon group having at least 1 and not more than 3 carbon atoms and more preferably a methyl group.

$R_2$, $R_3$ and $R_4$ each independently represent a halogen atom, a hydroxy group, an acetoxy group, or an alkoxy group (hereinafter referred to as a reactive group). These reactive groups are subjected to hydrolysis, addition polymerization, and condensation polymerization to form a cross-linked structure, and a toner having excellent anti-member contamination and development durability can be obtained. In consideration of gentle hydrolyzability at room temperature, precipitation of toner particles on the surface, and coatability, an alkoxy group having at least 1 and not more than 3 carbon atoms is preferable, and a methoxy group or an ethoxy group is more preferable. In addition, it is possible to control hydrolysis, addition polymerization and condensation polymerization for $R_2$, $R_3$ and $R_4$ according to the reaction temperature, the reaction time, the reaction solvent and pH.

In order to obtain an organosilicon polymer used in the present embodiment, an organosilicon compound (hereinafter referred to as a trifunctional silane) having three reactive groups ($R_2$, $R_3$ and $R_4$) in one molecule except for $R_1$ in Formula (Z) shown above may be used alone or a plurality of types thereof may be used in combination.

Examples of Formula (Z) include the following.

Trifunctional methylsilanes such as methyltrimethoxysilane, methyltriethoxysilane, methyldiethoxymethoxysilane, methylethoxydimethoxysilane, methyltrichlorosilane, methylmethoxydichlorosilane, methyl ethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldiethoxyhydroxysilane.

Trifunctional silanes such as ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane, and hexyltrihydroxysilane.

Trifunctional phenylsilanes such as phenyltrimethoxysilane, phenyltriethoxysilane, phenyltrichlorosilane, phenyltriacetoxysilane, and phenyltrihydroxysilane.

In addition, as long as the effects of the present embodiment are not impaired, an organosilicon polymer obtained using the following compound together with an organosilicon compound having a structure represented by Formula (Z) may be used. An organosilicon compound having four reactive groups in one molecule (tetrafunctional silane), an organosilicon compound having two reactive groups in one molecule (bifunctional silane), or an organosilicon compound having one reactive group (monofunctional silane). Examples thereof include the following.

Trifunctional vinyl silanes such as dimethyldiethoxysilane, tetraethoxysilane, hexamethyldisilazane, 3-aminopropyltrimethoxysilane, 3-aminopropyltriethoxysilane, 3-(2-aminoethyl)aminopropyltrimethoxysilane, 3-(2-aminoethyl) aminopropyltriethoxysilane, vinyltriisocyanatesilane, vinyltrimethoxysilane, vinyltriethoxysilane, vinyl diethoxymethoxysilane, vinylethoxydimethoxysilane, vinylethoxydihydroxysilane, vinyldimethoxyhydroxysilane, vinylethoxymethoxyhydroxysilane, and vinyldiethoxyhydroxysilane.

In addition, the content of the organosilicon polymers in the toner particles is preferably at least 0.5 mass % and not more than 10.5 mass %.

When the content of the organosilicon polymer is 0.5 mass % or more, it is possible to further reduce a surface free energy of the surface layer, it is possible to improve flowability, and it is possible to reduce the occurrence of member contamination and fogging. When the content is 10.5 mass % or less, it is possible to make it difficult for charge up to occur. The content of the organosilicon polymer can be controlled according to the type and amount of the organosilicon compound used to form the organosilicon polymer, the toner particle production method, the reaction temperature, the reaction time, the reaction solvent and pH when the organosilicon polymer is formed.

The surface layer and the toner particles are preferably in contact with each other with no gap. Thereby, the occurrence of bleeding due to a resin component, a release agent, or the like further inside than the surface layer of toner particles is reduced, and it is possible to obtain a toner having excellent storage stability, environmental stability, and development durability. In addition to the above organosilicon polymer, a resin such as a styrene-acrylic copolymer resin, a polyester resin, and a urethane resin, various additives, and the like may be incorporated into the surface layer.

Binder Resin

The toner particle may contain a binder resin. The binder resin is not particularly limited, and conventionally known resins can be used. A vinyl resin, a polyester resin, or the like is preferable. Examples of vinyl resins, polyester resins and other binder resins include the following resins and polymers.

Homopolymers of styrene such as polystyrene and polyvinyltoluene and substituted products thereof; styrene copolymers such as a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinylmethylether copolymer, a styrene-vinylethylether copolymer, a styrene-vinylmethylketone copolymer, a styrene-butadiene copolymer, a styrene-isoprene copolymer, a styrene-maleic acid copolymer, and a styrene-maleic acid ester copolymer; polymethylmethacrylate, polybutylmethacrylate, polyvinyl acetate, polyethylene, polypropylene, polyvinyl butyral, a silicone resin, a polyamide resin, an epoxy resin, a polyacrylic resin, rosin, a modified rosin, a terpene resin, a phenolic resin, an aliphatic or alicyclic hydrocarbon resin, and an aromatic petroleum resin. These binder resins can be used alone or in combination.

In consideration of charging performance, it is preferable that a binder resin have a carboxy group. A resin produced using a polymerizable monomer having a carboxy group is preferable. Examples thereof include (meth)acrylic acids such as α-ethylacrylic acid and crotonic acid, and α-alkyl derivatives or O-alkyl derivatives thereof; unsaturated dicarboxylic acids such as fumaric acid, maleic acid, citraconic acid, and itaconic acid; and unsaturated dicarboxylic acid monoester derivatives such as monoacryloyloxyethyl succinate ester, monoacryloyloxyethylene succinate ester, monoacryloyloxyethyl phthalate ester, and monomethacryloyloxyethyl phthalate ester.

Regarding polyester resins, those obtained by condensation polymerization of the following carboxylic acid components and alcohol components can be used. Examples of carboxylic acid components include terephthalic acid, isophthalic acid, phthalic acid, fumaric acid, maleic acid, cyclohexanedicarboxylic acid and trimellitic acid. Examples of alcohol components include bisphenol A, hydrogenated bisphenol, bisphenol A ethylene oxide adducts, bisphenol A propylene oxide adducts, glycerin, trimethylolpropane and pentaerythritol.

In addition, the polyester resin may be a polyester resin having a urea group. In the polyester resin, it is preferable that a carboxyl group at a terminal or the like be not capped.

In order to improve the change in viscosity of the toner at a high temperature, the binder resin may have a polymerizable functional group. Examples of polymerizable functional groups include a vinyl group, an isocyanate group, an epoxy group, an amino group, a carboxy group, and a hydroxy group.

Cross-Linking Agent

In order to control the molecular weight of the binder resin, a cross-linking agent may be added when polymerizable monomers are polymerized.

Examples thereof include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400, #600, dipropylene glycol diacrylate, polypropylene glycol diacrylate, polyester diacrylate (MANDA commercially available from Nippon Kayaku Co., Ltd.), and those obtained by modifying the above acrylates to methacrylates.

An amount of the cross-linking agent added is preferably at least 0.001 parts by mass and not more than 15.000 parts by mass with respect to 100 parts by mass of the polymerizable monomer.

Release Agent

The toner particles preferably contain a release agent. Examples of release agents that can be used for the toner particles include petroleum waxes such as a paraffin wax, a microcrystalline wax, and a petrolatum and derivatives thereof, Montan waxes and derivatives thereof, hydrocarbon waxes obtained by the Fischer-Tropsch process and derivatives thereof, polyolefin waxes such as polyethylene and polypropylene and derivatives thereof, natural waxes such as carnauba wax and candelilla wax and derivatives thereof, fatty acids such as higher aliphatic alcohols, stearic acid, and palmitic acid or compounds thereof, acid amide waxes, ester waxes, ketones, hydrogenated castor oils and derivatives thereof, plant waxes, animal waxes, and a silicone resin. Here, derivatives include block copolymers with oxides or vinyl monomers, and graft-modified products.

The content of the release agent is preferably at least 5.0 parts by mass and not more than 20.0 parts by mass with respect to 100.0 parts by mass of the binder resin or the polymerizable monomer.

Colorant

The toner particles may contain a colorant. The colorant is not particularly limited, and for example, the following known colorants can be used.

Examples of yellow pigments include condensed azo compounds of yellow iron oxides, Naples yellow, naphthol yellow S, hansa yellow G, hansa yellow 10G, benzidine yellow G, benzidine yellow GR, quinoline yellow lake, permanent yellow NCG, and tartrazine lake, isoindolinone compounds, anthraquinone compounds, azo metal complexes, methine compounds, and allylamide compounds. Specific examples thereof include the following pigments.

C. I. pigment yellow 12, 13, 14, 15, 17, 62, 74, 83, 93, 94, 95, 109, 110, 111, 128, 129, 147, 155, 168, 180.

Examples of orange pigments include the following pigments.

Permanent orange GTR, pyrazolone orange, vulcan orange, benzidine orange G, indanthren brilliant orange RK, and indanthren brilliant orange GK.

Examples of red pigments include condensed azo compounds such as red oxides, permanent red 4R, lithol red, pyrazolone red, watching red calcium salt, lake red C, lake D, brilliant carmine 6B, brillant carmine 3B, eosin lake, rhodamine lake B, and alizarin lake, diketopyrrolopyrrole compounds, anthraquinone compounds, quinacridone compounds, basic dye lake compounds, naphthol compounds, benzimidazolone compounds, thioindigo compounds, and perylene compounds. Specific examples thereof include the following pigments.

C. I. pigment red 2, 3, 5, 6, 7, 23, 48:2, 48:3, 48:4, 57:1, 81:1, 122, 144, 146, 166, 169, 177, 184, 185, 202, 206, 220, 221, 254.

Examples of blue pigments include copper phthalocyanine compounds of alkali blue lake, Victoria blue lake, phthalocyanine blue, metal-free phthalocyanine blue, phthalocyanine blue partial chlorides, fast sky blue, and indanthren blue BG and derivatives thereof, anthraquinone compounds, and basic dye lake compounds. Specific examples thereof include the following pigments.

C. I. pigment blue 1, 7, 15, 15:1, 15:2, 15:3, 15:4, 60, 62, 66.

Examples of purple pigments include fast violet B and methyl violet lake.

Examples of green pigments include pigment green B, malachite green lake, and final yellow green G.

Examples of white pigments include zinc oxide, titanium oxide, antimony white, and zinc sulfide.

Examples of black pigments include carbon black, aniline black, nonmagnetic ferrite, and magnetite, and those that are toned to black using the above yellow colorants, red colorants and blue colorants. These colorants can be used alone or in combination, and can be used in a solid solution state.

As necessary, a surface treatment of the colorant may be performed using a material that does not inhibit polymerization.

Here, the content of the colorant is preferably at least 3.0 parts by mass and not more than 15.0 parts by mass with respect to 100.0 parts by mass of the binder resin or the polymerizable monomer.

Charge Control Agent

The toner particles may contain a charge control agent. Regarding the charge control agent, known agents can be used. In particular, a charge control agent that has a high charging speed and can stably maintain a certain charge quantity is preferable. In addition, when the toner particles are produced according to a direct polymerization method, a charge control agent having a low polymerization inhibition ability and causing substantially no solubilizate in an aqueous medium is particularly preferable.

Examples of charge control agents that control toner particles such that they are negatively charged include the following agents.

Examples of organic metal compounds and chelate compounds include monoazo metal compounds, acetylacetone metal compounds, and aromatic oxycarboxylic acids, aromatic dicarboxylic acids, oxycarboxylic acids and dicarboxylic acid metal compounds. Other examples include aromatic oxycarboxylic acids, aromatic mono and polycarboxylic acids and metal salts thereof, anhydrides or esters, and phenol derivatives such as bisphenol. Additional examples include urea derivatives, metal-containing salicylic acid compounds, metal-containing naphthoic acid compounds, boron compounds, quaternary ammonium salts, and calixarene.

On the other hand, examples of charge control agents that control toner particles such that they are positively charged include the following agents.

Examples include nigrosine-modified products based on nigrosine and fatty acid metal salts; guanidine compounds; imidazole compounds; quaternary ammonium salts such as tributylbenzylammonium-1-hydroxy-4-naphthosulfonate and tetrabutylammonium tetrafluoroborate, and onium salts such as phosphonium salts as analogs thereof and lake pigments thereof; triphenylmethane dyes and lake pigments thereof (as laking agents, phosphotungstic acid, phosphomolybdic acid, phosphotungstic molybdic acid, tannic acid, lauric acid, gallic acid, ferricyanides, ferrocyanides, etc.); metal salts of higher fatty acids; and resin charge control agents.

These charge control agents can be contained alone or in combination of two or more thereof. An amount of the charge control agent added is preferably at least 0.01 parts by mass and not more than 10 parts by mass with respect to 100 parts by mass of the binder resin.

Method of Producing Toner Particles

Regarding a method of producing the toner particles, known methods can be used, and a kneading and pulverizing method or a wet production method can be used. In consideration of particle diameter uniformity and shape controllability, the wet production method is preferably used. In addition, examples of wet production methods include a suspension polymerization method, a dissolution suspension method, an emulsion polymerization aggregation method, and an emulsion aggregation method.

Here, the suspension polymerization method will be described. In the suspension polymerization method, first, polymerizable monomers for producing a binder resin and other additives such as a colorant are uniformly dissolved or dispersed using a disperser such as a ball mill and an ultrasonic disperser to prepare a polymerizable monomer composition (step of preparing a polymerizable monomer composition). In this case, as necessary, a multifunctional monomer, a chain transfer agent, a wax such as a release agent, a charge control agent, a plasticizer and the like can be appropriately added. Preferable examples of polymerizable monomers in the suspension polymerization method include the following vinyl polymerizable monomers.

Styrene; styrene derivatives such as α-methylstyrene, β-methylstyrene, o-methylstyrene, m-methyl styrene, p-methyl styrene, 2,4-dimethyl styrene, p-n-butyl styrene, p-tert-butyl styrene, p-n-hexyl styrene, p-n-octylstyrene, p-n-nonylstyrene, p-n-decylstyrene, p-n-dodecylstyrene, p-methoxystyrene, and p-phenylstyrene; acrylic polymerizable monomers such as methyl acrylate, ethyl acrylate, n-propyl acrylate, iso-propyl acrylate, n-butyl acrylate, iso-butylacrylate, tert-butylacrylate, n-amyl acrylate, n-hexylacrylate, 2-ethylhexylacrylate, n-octylacrylate, n-nonylacrylate, cyclohexylacrylate, benzylacrylate, dimethyl phosphate ethyl acrylate, diethyl phosphate ethyl acrylate, dibutyl phosphate ethyl acrylate, and 2-benzoyloxyethyl acrylate; methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; vinyl esters such as vinyl acetate, vinyl propionate, vinyl benzoate, vinyl butyrate, vinyl benzoate, and vinyl formate; vinyl ethers such as vinyl methyl ether, vinyl ethyl ether, and vinyl isobutyl ether; and vinyl methyl ketone, vinyl hexyl ketone, and vinyl isopropyl ketone.

Next, the polymerizable monomer composition is added to an aqueous medium prepared in advance, and droplets made of the polymerizable monomer composition are formed into toner particles with a desired size using a stirrer or disperser having a high shear force (granulation step).

It is preferable that the aqueous medium in the granulation step contain a dispersion stabilizer in order to control the particle diameter of the toner particles, sharpen the particle size distribution, and reduce aggregation of toner particles in the production procedure.

Dispersion stabilizers are generally broadly classified into polymers that exhibit a repulsive force due to steric hindrance and inorganic compounds with low water solubility that stabilize dispersion with an electrostatic repulsive force. Inorganic compound fine particles with low water solubility are suitably used because they dissolve in an acid or alkali and thus they can be dissolved and easily removed by washing with an acid or alkali after polymerization.

Regarding a dispersion stabilizer of the inorganic compound with low water solubility, those including any of magnesium, calcium, barium, zinc, aluminum, and phosphorus are preferably used. More preferably, it is desirable to include any of magnesium, calcium, aluminum, and phosphorus. Specific examples include the following.

Magnesium phosphate, tricalcium phosphate, aluminum phosphate, zinc phosphate, magnesium carbonate, calcium carbonate, magnesium hydroxide, calcium hydroxide, aluminum hydroxide, calcium metasilicate, calcium sulfate, barium sulfate, and hydroxyapatide. An organic compound, for example, a polyvinyl alcohol, gelatin, a sodium salt of methylcellulose, methylhydroxypropylcellulose, ethylcellulose, or carboxymethylcellulose, or starch may be used together with the dispersion stabilizer. At least 0.01 parts by mass and not more than 2.00 parts by mass of such a dispersion stabilizer with respect to 100 parts by mass of the polymerizable monomer is preferably used.

In addition, in order to refine such a dispersion stabilizer, at least 0.001 parts by mass and not more than 0.1 parts by mass of a surfactant may be used together with respect to 100 parts by mass of the polymerizable monomer. Specifically, commercially available nonionic, anionic, and cationic surfactants can be used. For example, sodium dodecyl sulfate, sodium tetradecyl sulfate, sodium pentadecyl sulfate, sodium octyl sulfate, sodium oleate, sodium laurate, potassium stearate, or calcium oleate is preferably used.

After the granulation step or while performing the granulation step, the temperature is preferably set to at least 50° C. and not more than 90° C., polymerizable monomers included in the polymerizable monomer composition being polymerized to obtain a toner particle dispersion solution (polymerization step).

In the polymerization step, a stirring operation is preferably performed so that the temperature distribution in the container becomes uniform. A polymerization initiator can be added at an arbitrary timing for a required time. In addition, in order to obtain a desired molecular weight distribution, the temperature may be raised in the latter half of the polymerization reaction, and in order to remove unreacted polymerizable monomers, byproducts, and the like to the outside of the system, some of the aqueous medium may be distilled off by a distillation operation in the latter half of the reaction or after the reaction is completed. The distillation operation can be performed under atmospheric pressure or a reduced pressure.

Regarding the polymerization initiator used in the suspension polymerization method, an oil-soluble initiator is generally used. Examples include the following.

Azo compounds such as 2,2'-azobisisobutyronitrile, 2,2'-azobis-2,4-dimethylvaleronitrile, 1,1'-azobis(cyclohexane-1-carbonitrile), and 2,2'-azobis-4-methoxy-2,4-dimethylvaleronitrile; and peroxide initiators such as acetylcyclohexylsulfonyl peroxide, diisopropyl peroxycarbonate, decanoyl peroxide, lauroyl peroxide, stearoyl peroxide, propionyl peroxide, acetyl peroxide, tert-butylperoxy-2-ethylhexanoate, benzoyl peroxide, tert-butyl peroxyisobutyrate, cyclohexanone peroxide, methyl ethyl ketone peroxide, dicumyl peroxide, tert-butyl hydroperoxide, di-tert-butyl peroxide, tert-butyl peroxypivalate, and cumene hydroperoxide.

Regarding the polymerization initiator, as necessary, a water soluble initiator may be used together, and examples thereof include the following.

Ammonium persulfate, potassium persulfate,
2,2'-azobis(N,N'-dimethyleneisobutyroamidine)hydrochloride,
2,2'-azobis(2-aminodinopropane)hydrochloride, azobis (isobutylamidine)hydrochloride,
2,2'-azobisisobutyronitrile sodium sulfonate, ferrous sulfate or hydrogen peroxide.

These polymerization initiators can be used alone or a plurality of types thereof can be used in combination. In order to control the degree of polymerization of the polymerizable monomer, a chain transfer agent, a polymerization inhibitor, and the like can be additionally added and then used.

Regarding the particle diameter of the toner particles, in order to obtain a high definition and high resolution image, the weight-average particle diameter is preferably at least 3.0 μm and not more than 10.0 The toner particle dispersion solution obtained in this manner is subjected to a filtering step for solid-liquid separation of toner particles and the aqueous medium.

Method of Measuring Weight-Average Particle Diameter D4 of Toner Particles

The weight-average particle diameter (D4) of the toner particles is calculated as follows. Regarding a measuring device, a precision particle size distribution measuring device "Coulter Counter Multisizer 3" (registered trademark, commercially available from Beckman Coulter, Inc.) having an aperture tube of 100 μm using a pore electrical resistance method is used. For measurement condition setting and measurement data analysis, bundled dedicated software "commercially available from Beckman Coulter, Inc. Multisizer 3 Version 3.51" (commercially available from Beckman Coulter, Inc.) is used. Here, the measurement is performed with 25000 effective measurement channels.

Regarding an electrolyte aqueous solution used for measurement, "ISOTON II" (commercially available from Beckman Coulter, Inc.) obtained by dissolving special grade sodium chloride in deionized water so that the concentration is about 1 mass % is used.

Here, before measurement and analysis are performed, the dedicated software is set as follows.

On the screen "Change standard measurement method (SOMME)" in the dedicated software, the total count number in the control mode is set to 50000 particles, the number of measurements is set to 1, and the Kd value is set to a value obtained using "standard particles 10.0 μm" (commercially available from Beckman Coulter, Inc.). When "the threshold value/noise level measurement button" is pressed, the threshold value and the noise level are automatically set. In addition, the current is set to 1,600 pA, the gain is set to 2, the electrolyte solution is set to ISOTON II, and "flush aperture tube after measurement" is checked.

On the screen "conversion setting from pulse to particle diameter" in the dedicated software, the bin interval is set to a logarithmic particle diameter, the particle diameter bin is set to a 256 particle diameter bin, and the particle diameter range is set to 2 μm to 60 μm.

A specific measurement method is as follows.

(1) About 200 mL of the electrolyte aqueous solution is put into a 250 mL glass round-bottom beaker dedicated for the Multisizer 3, the beaker is set on a sample stand, and stirring is performed using a stirrer rod counterclockwise at 24 revolutions/second. Then, dust and bubbles in the aperture tube are removed according to the function "flush aperture tube" in the dedicated software.

(2) About 30 mL of the electrolyte aqueous solution is put into a 100 mL glass flat-bottomed beaker. About 0.3 ml of a diluted solution obtained by diluting "Contaminone N" (a 10 mass % aqueous solution of a neutral detergent for washing a precision measurement instrument which includes a nonionic surfactant, an anionic surfactant, and an organic builder and has pH 7, commercially available from Wako Pure Chemical Industries, Ltd.) in deionized water by a factor of about 3 (based on the mass) is added thereto as a dispersant.

(3) An ultrasonic disperser "Ultrasonic Dispersion System Tetra 150" (commercially available from Nikkaki Bios Co., Ltd.) with an electrical output of 120 W into which two oscillators with an oscillation frequency of 50 kHz and of which phases are shifted by 180 degrees are built is prepared. About 3.3 L of deionized water is put into a water tank of the ultrasonic disperser, and about 2 mL of Contaminone N is added to the water tank.

(4) The beaker in the above (2) is set in a beaker fixing hole of the ultrasonic disperser and the ultrasonic disperser is operated. Then, the height position of the beaker is adjusted so that the resonance state of the liquid level of the electrolyte aqueous solution in the beaker is maximized.

(5) While ultrasound is emitted to the electrolyte aqueous solution in the beaker in the above (4), small amounts of about 10 mg of the toner particles are added to and dispersed in the electrolyte aqueous solution. Then, an ultrasonic dispersion treatment additionally continues for 60 seconds. Here, in ultrasonic dispersion, the temperature of water in the water tank is appropriately adjusted to at least 10° C. and not more than 40° C.

(6) The electrolyte aqueous solution in the above (5) in which toner particles are dispersed is added dropwise to the round-bottom beaker in the above (1) placed in the sample stand using a pipette, and the measurement concentration is adjusted to about 5%. Then, measurement is performed until the number of measured particles is 50000.

(7) Measurement data is analyzed using the dedicated software bundled in the device and the weight-average particle diameter (D4) is calculated. Here, "average diameter" on the screen "analysis/volume statistical value (arithmetic mean)" when graph/volume % is set in the dedicated software is set to weight-average particle diameter (D4).

The solid-liquid separation for obtaining toner particles from the obtained toner particle dispersion solution can be performed by a general filtration method. Then, in order to remove foreign substances that have not been removed from the surface of the toner particles, it is preferable to perform additional washing according to re-slurry-washing or washing with water. After sufficient washing is performed, solid-liquid separation is performed again to obtain a toner cake. Then, drying is performed by a known drying method, and as necessary, particle groups having a particle diameter other than a predetermined size are separated by classification to obtain toner particles. In this case, the separated particle groups having a particle diameter other than a predetermined size may be used again in order to improve the final yield.

When the surface of the toner particles is covered with an organosilicon polymer having a structure represented by Formula (1) to form a surface layer containing the organosilicon polymer, while performing a polymerization step or the like in the aqueous medium, a hydrolysis solution of the organosilicon compound can be added to form the surface layer as described above.

Alternatively, the dispersion solution of toner particles after polymerization is used as a core particle dispersion solution, and the hydrolysis solution of the organosilicon compound may be added to form the surface layer. Furthermore, it is also acceptable that, in cases other than the aqueous medium such as a kneading pulverization method, the obtained toner particles are dispersed in an aqueous medium and used as a core particle dispersion solution, and the hydrolysis solution of the organosilicon compound can be added to form the surface layer as described above.

Method of Preparing THF Insoluble Matter of Toner Particles for NMR Measurement

A tetrahydrofuran (THF) insoluble matter of toner particles was prepared as follows.

10.0 g of toner particles were weighed out and put into a cylindrical filter paper (No. 86R commercially available from Toyo Roshi Kaisha, Ltd.) and caused to pass through a Soxhlet extractor. 200 mL of THF was used as a solvent, extraction was performed for 20 hours, the residue obtained by vacuum-drying the filtrate in the cylindrical filter paper at 40° C. for several hours was set as a THF insoluble matter of toner particles for NMR measurement.

Here, when the surface of toner particles was treated with an external additive or the like, the external additive was removed by the following method to obtain toner particles.

160 g of sucrose (commercially available from Kishida Chemical Co., Ltd.) was added to 100 mL of deionized water, and dissolved in a water bath, and thereby a sucrose concentrated solution was prepared. 31 g of the sucrose concentrated solution and 6 mL of Contaminone N (a 10 mass % aqueous solution of a neutral detergent for washing a precision measurement instrument which included a nonionic surfactant, an anionic surfactant, and an organic builder and had pH 7, commercially available from Wako Pure Chemical Industries, Ltd.) were put into a centrifuge tube (with a volume of 50 mL) to produce a dispersion solution. 1.0 g of the toner was added to the dispersion solution, and the toner mass was disintegrated using a spatula or the like.

The centrifuge tube was shaken in a shaker at 350 spm (strokes per min) for 20 minutes. After shaking, the solution was moved to a glass tube for a swing rotor (with a volume of 50 mL), and separated in a centrifuge (H-9R commercially available from Kokusan Co., Ltd.) under conditions of 3,500 rpm for 30 minutes. According to this operation, toner particles and the detached external additive were separated. It was visually confirmed that the toner and the aqueous solution were sufficiently separated, and the toner separated in the top layer was collected using a spatula or the like. The collected toner was filtered in a filtration machine under a reduced pressure, and drying was then performed in a dryer for 1 hour or longer, and thereby toner particles were obtained. This operation was performed a plurality of times and a required amount was secured.

Method of Confirming Structure Represented By Formula (1)

In order to confirm the structure represented by Formula (1) in the organosilicon polymer contained in toner particles, the following method was used.

The hydrocarbon group represented by R in Formula (1) was confirmed according to 13C-NMR.

$^{13}$C-NMR (Solid) Measurement Conditions

Device: JNM-ECX500II commercially available from JEOLRESONANCE

Sample tube: 3.2 mmφ
Sample: 150 mg of tetrahydrofuran insoluble matter of toner particles for NMR measurement
Measurement temperature: room temperature
Pulse mode: CP/MAS
Measurement nuclear frequency: 123.25 MHz ($^{13}C$)
Reference substance: adamantine (external standard: 29.5 ppm)
Sample rotational speed: 20 kHz
Contact time: 2 ms
Delay time: 2 s
Cumulative number: 1,024

In this method, a hydrocarbon group represented by R in Formula (1) was confirmed according to the presence or absence of a signal caused by a methyl group (Si—$CH_3$), an ethyl group (Si—$C_2H_5$), a propyl group (Si—$C_3H_7$), a butyl group (Si—$C_4H_9$), a pentyl group (Si—$C_5H_{11}$), a hexyl group (Si—$C_6H_{13}$) or a phenyl group (Si—$C_6H_5$—) bonded to a silicon atom.

Method of Calculating Proportion of Peak Area Ascribed to Structure of Formula (1) in Organosilicon Polymer Contained in Toner Particles $^{29}$Si-NMR (solid) measurement of a THF insoluble matter of toner particles was performed under the following measurement conditions.

$^{29}$Si-NMR (Solid) Measurement Conditions
Device: JNM-ECX500II commercially available from JEOLRESONANCE
Sample tube: 3.2 mmφ
Sample: 150 mg of tetrahydrofuran insoluble matter of toner particles for NMR measurement
Measurement temperature: room temperature
Pulse mode: CP/MAS
Measurement nuclear frequency: 97.38 MHz ($^{29}$Si)
Reference substance: DSS (external standard: 1.534 ppm)
Sample rotational speed: 10 kHz
Contact time: 10 ms
Delay time: 2 s
Cumulative number: 2000 to 8000

After the measurement, in a plurality of silane components having different substituents and linking groups in the tetrahydrofuran insoluble matter of toner particles, peaks were separated into the following X1 structure, X2 structure, X3 structure, and X4 structure according to curve fitting, and respective peak areas were calculated.

X1 structure: $(Ri)(Rj)(Rk)SiO_{1/2}$ (2)

X2 structure: $(Rg)(Rh)Si(O_{1/2})_2$ (3)

X3 structure: $RmSi(O_{1/2})_3$ (4)

X4 structure: $Si(O_{1/2})_4$ (5)

X1 Structure:

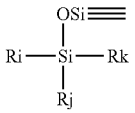

(2)

X2 Structure:

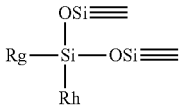

(3)

-continued

X3 Structure:

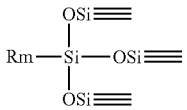

(4)

X4 Structure:

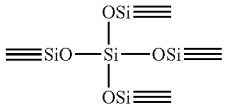

(5)

(In Formulae (2), (3) and (4), Ri, Rj, Rk, Rg, Rh, and Rm represent an organic group such as a hydrocarbon group having 1 to 6 carbon atoms, a halogen atom, a hydroxy group, an acetoxy group or an alkoxy group, which is bonded to a silicon atom.)

In the present embodiment, in the chart obtained by $^{29}$Si-NMR measurement of a THF insoluble matter of toner particles, the proportion of the peak area ascribed to the structure of Formula (1) with respect to the entire peak area of the organosilicon polymer was preferably 20% or more.

Here, when it is necessary to confirm the structure represented by Formula (1) in more detail, the structure may be identified according to $^{1}$H-NMR measurement results together with the above $^{13}$C-NMR and $^{29}$Si-NMR measurement results.

Method of Measuring Proportion of Surface Layer Containing Organosilicon Polymer, Which Has Thickness of 2.5 Nm or Less, Measured in Observation of Cross Section of Toner Particle Using Transmission Electron Microscope (TEM)

In the present embodiment, the cross section of toner particles was observed according to the following method.

Regarding a specific method of observing the cross section of toner particles, toner particles were sufficiently dispersed in a curable epoxy resin at normal temperature, and then cured for 2 days in an atmosphere of 40° C. A flaky sample was cut out from the obtained cured product using a microtome having diamond teeth. This sample was enlarged at a magnification of 10000 to 100000 under a transmission electron microscope (JEM-2800 commercially available from JEOL) (TEM), and the cross section of toner particles was observed.

Confirmation can be made using the fact that the contrast was brighter when the atomic weight was larger using a difference in atomic weights between the binder resin and the surface layer material. In order to impart contrast between materials, a ruthenium tetroxide staining method or an osmium tetroxide staining method was used.

Regarding particles used for the measurement, an equivalent circle diameter Dtem was obtained from the cross section of toner particles obtained through the above TEM photomicrograph, and its value was within in the width of ±10% of the weight-average particle diameter D4 of the toner particles.

As described above, using JEM-2800 (commercially available from JEOL), a dark field image of the cross section of toner particles was acquired at an acceleration voltage of 200 kV. Next, using EELS detector GIFQuantam (commercially available from Gatan), a mapping image was acquired according to the ThreeWindow method, and thereby the surface layer was confirmed.

Figure 5:
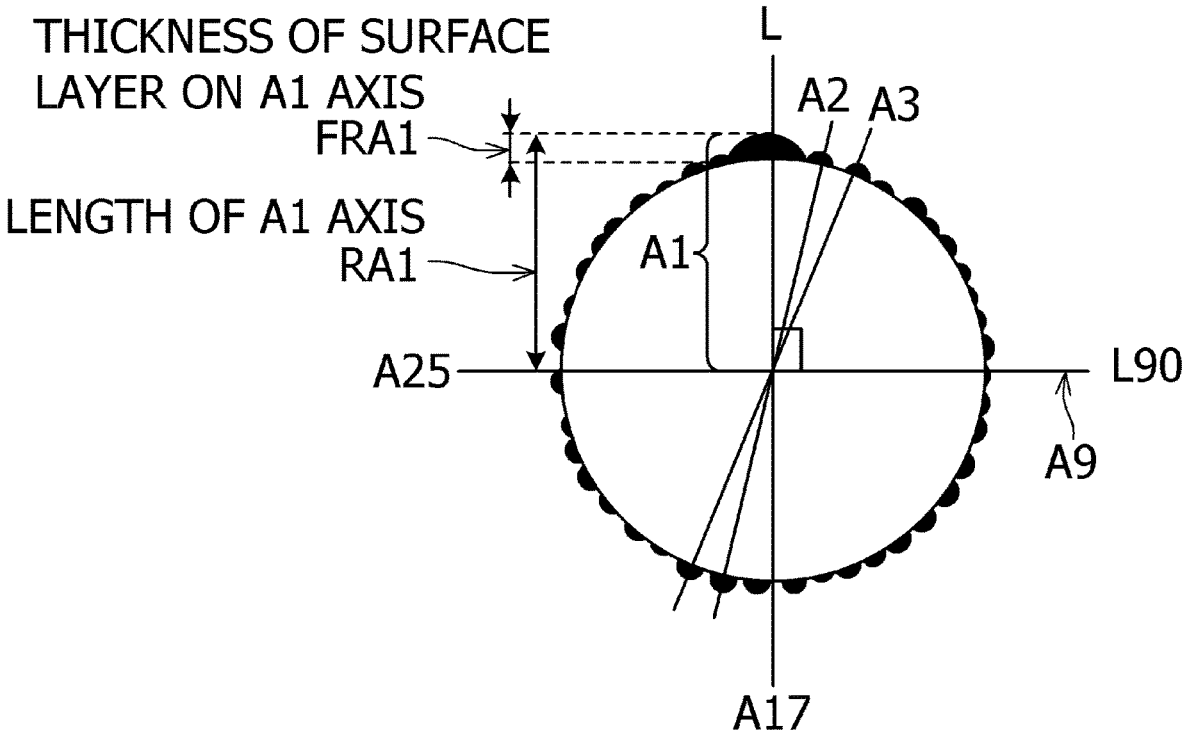
FIG. 5 is a conceptual view of a surface layer thickness of a surface layer containing an organosilicon compound in the embodiment.

Next, regarding one toner particle in which the equivalent circle diameter Dtem was within in the width of ±10% of the weight-average particle diameter D4 of toner particles, based on the intersection between the long axis L of the cross section of the toner particle and the axis L90 that passes through the center of the long axis L and is perpendicular thereto, the cross section of the toner particle was uniformly divided into 16 segments (refer to FIG. 5). Next, division axes from the center toward the surface layer of the toner particle were set as An (n=1 to 32), the length of the division axis was set as RAn, and the thickness of the surface layer was set as FRAn.

Then, a proportion of the number of division axes in which the thickness of the surface layer containing the organosilicon polymer on each of the 32 division axes was 2.5 nm or less was obtained. For averaging, 10 toner particles were measured, and an average value per one toner particle was calculated.

Equivalent Circle Diameter (Dtem) Obtained from Cross Section of Toner Particle Obtained in Transmission Electron Microscope (TEM) Image The equivalent circle diameter (Dtem) obtained from the cross section of the toner particle obtained in a TEM image was obtained according to the following method. First, for one toner particle, the equivalent circle diameter Dtem obtained from the cross section of the toner particle obtained in the TEM image was obtained according to the following formula. [Equivalent circle diameter (Dtem) obtained from the cross section of the toner particle obtained in the TEM image]=(RA1+RA2+RA3+RA4+RA5+RA6+RA7+RA8+RA9+RA10+RA11+RA12+RA13+RA14+RA15+RA16+RA17+RA18+RA19+RA20+RA21+RA22+RA23+RA24+RA25+RA26+RA27+RA28+RA29+RA30+RA31+RA32)/16

The equivalent circle diameters of 10 toner particles were obtained, and an average value per one particle was calculated to obtain the equivalent circle diameter (Dtem) obtained from the cross section of the toner particle.

Proportion of Surface Layer Containing Organosilicon Polymer, which as Thickness of 2.5 Nm or Less

[Proportion of the surface layer containing an organosilicon polymer, which has a thickness (FRAn) of 2.5 nm or less]=[{the number of division axes in which the thickness (FRAn) of the surface layer containing an organosilicon polymer is 2.5 nm or less}/32]×100

This calculation was performed for 10 toner particles, an average value of proportions in which the thickness (FRAn) of the obtained 10 surface layers was 2.5 nm or less was obtained as a proportion of the surface layer of the toner particle having a thickness (FRAn) of 2.5 nm or less.

Method of Measuring Adhesion Rate of Organosilicon Polymers 160 g of sucrose (commercially available from Kishida Chemical Co., Ltd.) was added to 100 mL of deionized water, and dissolved in a water bath, and thereby a sucrose concentrated solution was prepared. 31 g of the sucrose concentrated solution and 6 mL of Contaminone N (a 10 mass % aqueous solution of a neutral detergent for washing a precision measurement instrument which included a nonionic surfactant, an anionic surfactant, and an organic builder and had pH 7, commercially available from Wako Pure Chemical Industries, Ltd.) were put into a centrifuge tube (with a volume of 50 mL) to produce a dispersion solution. 1.0 g of the toner was added to the dispersion solution, and the toner mass was disintegrated using a spatula or the like.

The centrifuge tube was shaken in a shaker at 350 spm (strokes per min) for 20 minutes. After shaking, the solution was moved to a glass tube for a swing rotor (with a volume of 50 mL), and separated in a centrifuge (H-9R commercially available from Kokusan Co., Ltd.) under conditions of 3,500 rpm for 30 minutes. It was visually confirmed that the toner and the aqueous solution were sufficiently separated, and the toner separated in the top layer was collected using a spatula or the like. The aqueous solution containing the collected toner was filtered in a filtration machine under a reduced pressure and drying was then performed in a dryer for 1 hour or longer. The dried product was deagglomerated using a spatula, and an amount of silicon was measured through X-ray fluorescence. A fixing rate (%) was calculated based on the ratio of amounts of elements to be measured between the toner after washing and the toner before washing.

The X-ray fluorescence of elements was measured according to JIS K 0119-1969, and details are as follows.

Regarding a measuring device, a wavelength dispersive X-ray fluorescence analyzing device "Axios" (commercially available from PANalytical), and bundled dedicated software "SuperQ ver. 4.0F" (commercially available from PANalytical) for measurement condition setting and measurement data analysis were used. Here, Rh was used as an X-ray tube anode, the measurement atmosphere was a vacuum, the measurement diameter (collimator mask diameter) was 10 mm, and the measurement time was 10 seconds. In addition, when a light element was measured, the X-ray fluorescence was detected by a proportional counter (PC), and when a heavy element was measured, the X-ray fluorescence was detected by a scintillation counter (SC).

Regarding a measurement sample, pellets obtained by putting about 1 g of the toner after washing with water and the initial toner into an exclusive aluminum ring for pressing with a diameter of 10 mm and flattening it, and performing pressing at 20 MPa for 60 seconds using a tablet molding compressor "BRE-32" (commercially available from Maekawa Testing Machine MFG. Co., Ltd.), and performing molding to a thickness of about 2 mm were used.

Measurement was performed under the above conditions, an element was identified based on the obtained X-ray peak position, and its concentration was calculated from a counting rate (unit: cps) which was the number of X-ray photons per unit time.

In a quantitative method in the toner, for example, regarding an amount of silicon, for example, 0.5 parts by mass of silica ($SiO_2$) fine powder was added with respect to 100 parts by mass of toner particles, and the mixture was sufficiently mixed using a coffee mill. In the same manner, 2.0 parts by mass and 5.0 parts by mass of silica fine powder were mixed together with toner particles, and these were used as calibration curve samples.

Regarding the samples, using a tablet molding compressor, calibration curve sample pellets were produced as described above, and the counting rate (unit: cps) of Si-Kα rays observed at a diffraction angle (2θ)=109.08° when PET was used as a dispersive crystal was measured. In this case, the acceleration voltage and the current value of an X-ray generation device were 24 kV and 100 mA. A linear function calibration curve in which the vertical axis represented the obtained X-ray counting rate and the horizontal axis represented an amount of $SiO_2$ added in each calibration curve sample was obtained.

Next, the toner to be analyzed was formed into pellets as described above using a tablet molding compressor, and the counting rate of Si-Kα rays was measured. Then, the content of organosilicon polymers (silicon) the toner was obtained from the above calibration curve. The ratio of the silicone amount in the toner after washing to the silicon amount in the toner before washing calculated by the above method was obtained and used as a fixing rate (%).

<1-7> Production of Toner in the Present Embodiment

Hereinafter, unless otherwise specified, "parts" of materials are all based on the mass.

Step of Preparing Aqueous Medium 1

14.0 parts of sodium phosphate (12 hydrate, commercially available from Rasa Industries, Ltd.) was put into 1000.0 parts of deionized water in a reaction container and the mixture was kept at 65° C. for 1.0 hours while purging with nitrogen gas.

While stirring at 12000 rpm using a T. K. Homomixer (commercially available from Tokushu Kika Kogyo Co., Ltd.), a calcium chloride aqueous solution in which 9.2 parts of calcium chloride (dihydrate) was dissolved in 10.0 parts of deionized water was added together to prepare an aqueous medium containing a dispersion stabilizer. In addition, 10 mass % hydrochloric acid was added to the aqueous medium, pH was adjusted to 5.0, and thereby an aqueous medium 1 was obtained.

Step of Hydrolyzing Organosilicon Compound for Surface Layer 60.0 parts of deionized water was weighed out in a reaction container including a stirrer and a thermometer, and pH was adjusted to 3.0 using 10 mass % of hydrochloric acid. The result was heated with stirring and the temperature was set to 70° C. Then, 40.0 parts of methyltriethoxysilane which was an organosilicon compound for a surface layer was added and the mixture was stirred for 2 hours or longer and hydrolyzed. At the end point of hydrolysis, it was visually confirmed that oil and water were not separated but formed one layer, cooling was performed, and a hydrolysis solution of an organosilicon compound for a surface layer was obtained.

Step of Preparing Polymerizable Monomer Composition

| | |
|---|---|
| Styrene | 60.0 parts |
| C. I. Pigment blue 15:3 | 6.5 parts |

The materials were put into an attritor (commercially available from Mitsui Miike Machinery Co., Ltd.), and additionally, dispersion was performed using zirconia particles with a diameter of 1.7 mm at 220 rpm for 5.0 hours to prepare a pigment dispersion solution. The following materials were added to the pigment dispersion solution.

| | |
|---|---|
| Styrene | 20.0 parts |
| n-butyl acrylate | 20.0 parts |
| Cross-linking agent (divinylbenzene) | 0.3 parts |
| Saturated polyester resin (polycondensate of propylene oxide modified bisphenol A (2 mol adduct) and terephthalic acid (molar ratio 10:12), glass transition temperature Tg = 68° C., weight-average molecular weight Mw = 10000, and molecular weight distribution Mw/Mn = 5.12) | 5.0 parts |
| Fischer-Tropsch wax (melting point 78° C.) | 7.0 parts |

The mixture was kept at 65° C. and uniformly dissolved and dispersed using a T. K. Homomixer (commercially available from Tokushu Kika Kogyo Co., Ltd.), at 500 rpm to prepare a polymerizable monomer composition.

Granulating Step

The temperature of the aqueous medium 1 was set to 70° C., and while maintaining the rotational speed of the T. K. Homomixer at 12000 rpm, the polymerizable monomer composition was added to the aqueous medium 1, and 9.0 parts of t-butyl peroxypivalate as a polymerization initiator was added. Granulation was performed for 10 minutes while maintaining 12000 rpm in the stirring device without change.

Polymerizing Step

After the granulation step, the stirrer was replaced with a propeller stirring blade, polymerization was performed for 5.0 hours with stirring at 150 rpm while the temperature was maintained at 70° C., and the polymerization reaction was caused by raising the temperature to 85° C. and heating for 2.0 hours, and thereby core particles were obtained. When the temperature of the slurry was cooled at 55° C. and pH was measured, pH was 5.0. While stirring continued at 55° C., 20.0 parts of a hydrolysis solution of an organosilicon compound for a surface layer was added and formation of the surface layer of the toner particle started. After maintaining for 30 minutes without change, the slurry was adjusted to pH=9.0 for completing condensation using a sodium hydroxide aqueous solution, and was additionally left for 300 minutes, and the surface layer was formed.

Washing and Drying Step

After the polymerization step was completed, the toner particle slurry was cooled, and hydrochloric acid was added to the toner particle slurry so that pH was adjusted to 1.5 or less, the mixture was stirred and left for 1 hour, and solid-liquid separation was then performed using a pressure filter, and a toner particle cake was obtained. This was re-slurried with deionized water to make a dispersion solution again, and solid-liquid separation was then performed using the above filter. The re-slurrying and solid-liquid separation were repeated until the electrical conductivity of the filtrate was 5.0 μS/cm or less and finally solid-liquid separation was then performed to obtain a toner particle cake.

The obtained toner particle cake was dried using an airflow dryer flash jet dryer (commercially available from Seishin Enterprise Co., Ltd.), and additionally, fine powder was cut using a multi-grade classifier using a Coanda effect to obtain toner particles 1. Regarding drying conditions, the blowing temperature was set to 90° C., the dryer outlet temperature was set to 40° C., and the toner particle cake supply speed was adjusted to a speed at which the outlet temperature did not deviate from 40° C. according to the content of water of the toner particle cake.

Silicon mapping was performed in observation of the cross section of toner particles 1 under a TEM, and it was confirmed that silicon atoms were present on the surface layer, and the proportion of the number of division axes in which the thickness of the surface layer of toner particles containing organosilicon polymers was 2.5 nm or less was 20.0% or less. In all of the toners of the following examples, it was confirmed that, in the surface layer containing organosilicon polymers, silicon atoms were present on the surface layer according to the same silicon mapping, and the proportion of the number of division axes in which the thickness of the surface layer was 2.5 nm or less was 20.0% or less. In this embodiment, the obtained toner particles were directly used as a toner (A) without external addition of any of silica fine particles.

The fixing rate of the organosilicon polymer having a structure represented by the following Formula (1) covering the surface of the toner particles with respect to toner particles in the toner (A) of the present embodiment was 30% or more. This is because the attachment force between toner particles increased and charging performance varied when the area of the surface layer in which there were no organosilicon polymer increased.

<1-8> Experiment

The toner (A) of the present embodiment produced so that the fixing rate obtained according to the measurement method of the present embodiment was 95% to 97% in increments of 1% was prepared. In addition, regarding a comparative example, a toner (B) of a comparative example in which inorganic silicon fine particles were externally added to toner particles in order to secure flowability and improve charging performance was prepared.

The fixing rate of the toner (A) of the present embodiment varied depending on toner production conditions. In the present embodiment, toners having different fixing rates were produced by changing conditions in which a hydrolysis solution was added in the polymerization step and a retention time after addition. Here, the pH of the slurry was adjusted using hydrochloric acid and a sodium hydroxide aqueous solution. Table 1 shows conditions for producing toners having different fixing rates.

TABLE 1

Conditions for producing toners (A) having different fixing rates of the present embodiment

| | Conditions when a hydrolysis solution was added | | | Conditions after a hydrolysis solution was added |
|---|---|---|---|---|
| Fixing rate (%) | Slurry-pH | Slurry-temperature (° C.) | Number of parts of hydrolysis solution added (parts) | Retention time until pH for completing condensation was adjusted |
| 95 | 5.0 | 45 | 20.0 | 60 |
| 96 | 5.0 | 55 | 20.0 | 10 |
| 97 | 5.0 | 55 | 20.0 | 30 |

Next, a method of producing a toner (B) of a comparative example will be described below.

Step of Preparing Aqueous Medium 1

14.0 parts of sodium phosphate (12 hydrate, commercially available from Rasa Industries, Ltd.) was added to 1000.0 parts of deionized water in a reaction container, and the mixture was kept at 65° C. for 1.0 hour while purging with nitrogen gas.

While stirring at 12000 rpm using a T. K. Homomixer (commercially available from Tokushu Kika Kogyo Co., Ltd.), a calcium chloride aqueous solution in which 9.2 parts of calcium chloride (dihydrate) was dissolved in 10.0 parts of deionized water was added to prepare an aqueous medium containing a dispersion stabilizer. In addition, 10 mass % hydrochloric acid was added to the aqueous medium, the pH was adjusted to 5.0, and thereby an aqueous medium 1 was obtained.

Step of Preparing Polymerizable Monomer Composition

| | |
|---|---|
| Styrene | 60.0 parts |
| C. I. pigment blue 15:3 | 6.5 parts |

The materials were put into an attritor (commercially available from Mitsui Miike Machinery Co., Ltd.), and additionally, dispersion was performed using zirconia particles with a diameter of 1.7 mm at 220 rpm for 5.0 hours to prepare a pigment dispersion solution. The following materials were added to the pigment dispersion solution.

| | |
|---|---|
| Styrene: | 20.0 parts |
| n-Butyl acrylate: | 20.0 parts |
| Cross-linking agent (divinylbenzene): | 0.3 parts |
| Saturated polyester resin: (polycondensate of propylene oxide modified bisphenol A (2 mol adduct) and terephthalic acid (molar ratio 10:12), glass transition temperature Tg = 68° C., weight-average molecular weight Mw = 10,000, and molecular weight distribution Mw/Mn = 5.12) | 5.0 parts |
| Fischer-Tropsch wax (melting point 78° C.): | 7.0 parts |

The mixture was kept at 65° C. and uniformly dissolved and dispersed using a T. K. Homomixer (commercially available from Tokushu Kika Kogyo Co., Ltd.), at 500 rpm to prepare a polymerizable monomer composition.

Granulating Step

The temperature of the aqueous medium 1 was set to 70° C., and while maintaining the rotational speed of the T. K. Homomixer at 12000 rpm, the polymerizable monomer composition was added to the aqueous medium 1, and 9.0 parts of t-butyl peroxypivalate as a polymerization initiator was added. Granulation was performed for 10 minutes while maintaining 12000 rpm in the stirring device without change.

Polymerizing Step

After the granulation step, the stirrer was replaced with a propeller stirring blade, polymerization was performed for 5.0 hours with stirring at 150 rpm while the temperature was maintained at 70° C., and the polymerization reaction was caused by raising the temperature to 85° C. and heating for 2.0 hours. The temperature of the obtained slurry was cooled to obtain a toner particle slurry.

Washing and Drying Step

Hydrochloric acid was added to the toner particle slurry so that the pH was adjusted to 1.5 or less, the mixture was stirred and left for 1 hour, and solid-liquid separation was then performed using a pressure filter, and a toner cake was obtained. This was re-slurried with deionized water to make a dispersion solution again, and solid-liquid separation was then performed using the above filter. The re-slurrying and solid-liquid separation were repeated until the electrical conductivity of the filtrate was 5.0 μS/cm or less and finally solid-liquid separation was then performed to obtain a toner cake.

The obtained toner cake was dried using an airflow dryer flash jet dryer (commercially available from Seishin Enterprise Co., Ltd.), and additionally, fine powder was cut out using a multi-grade classifier using a Coanda effect to obtain a toner particle (b). Regarding drying conditions, the blowing temperature was set to 90° C., the dryer outlet temperature was set to 40° C., and the toner cake supply speed was adjusted to a speed at which the outlet temperature did not deviate from 40° C. according to the content of water of the toner cake.

External Addition of Silica Fine Particles

Silica fine particles were externally added to the toner particles (b) according to the method described in the example in Japanese Patent Application Publication No. 2016-38591 to obtain a toner (B) of a comparative example.

That is, silica fine particles (RY200 commercially available from Nippon Aerosil Co., Ltd.) were externally added to the toner particles (b) and coarse particles were then removed using a 200 mesh sieve, and thereby a toner (B) of a comparative example was obtained.

That is, with respect to 100 parts of the toner particles (b), 1.8 parts of the silica fine particles (1.0 part in the first step and 0.8 parts in the second step) were subjected to a two-step treatment under conditions shown in Table 2 using a toner processing device (surface modification device) 101 shown in FIG. 8 to FIG. 12C. Then, coarse particles were removed using a 200 mesh sieve, and thereby a toner (B) of a comparative example was obtained.

Figure 8:
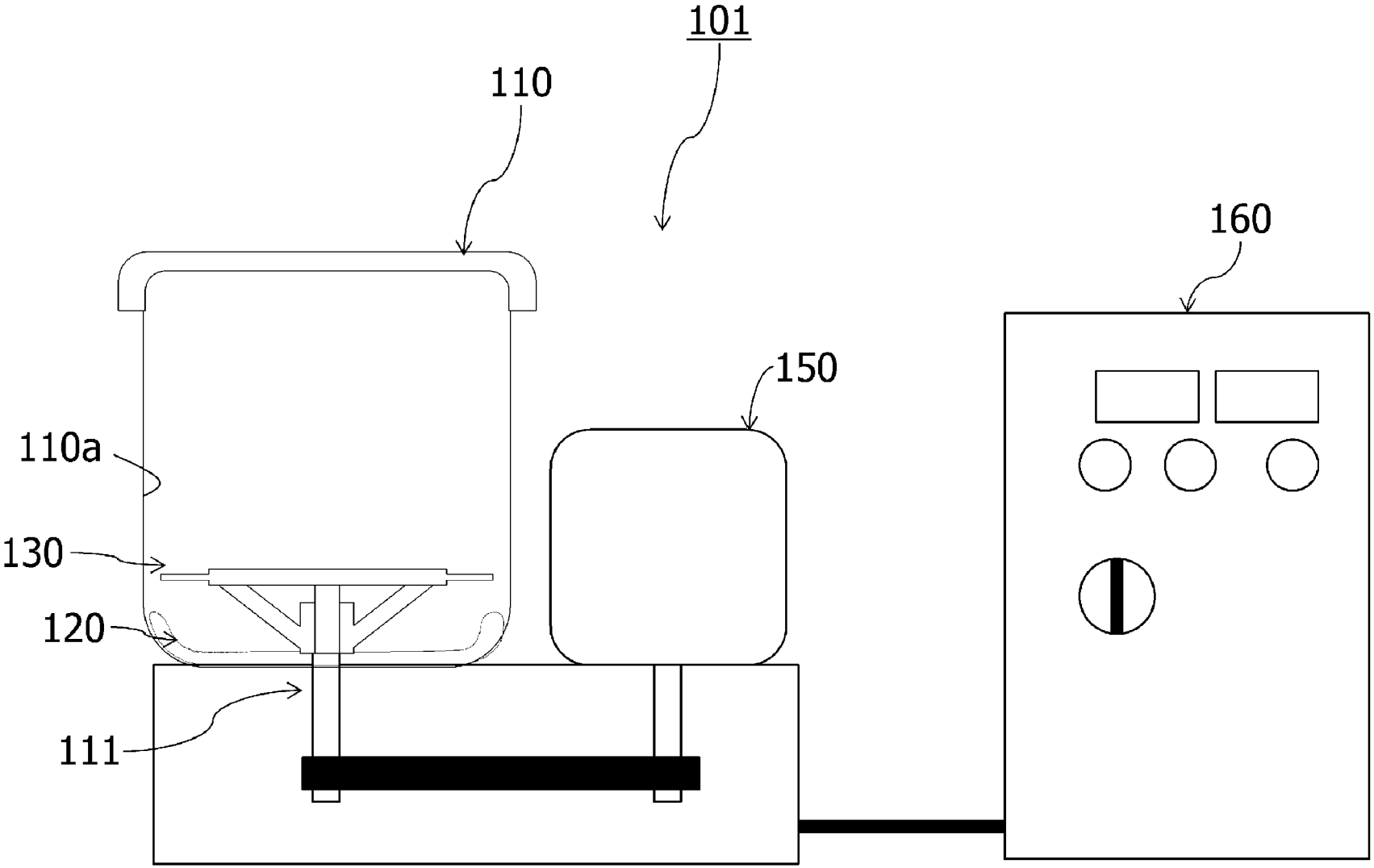
FIG. 8 is a schematic view showing a surface modification device in the embodiment.
Figure 9:
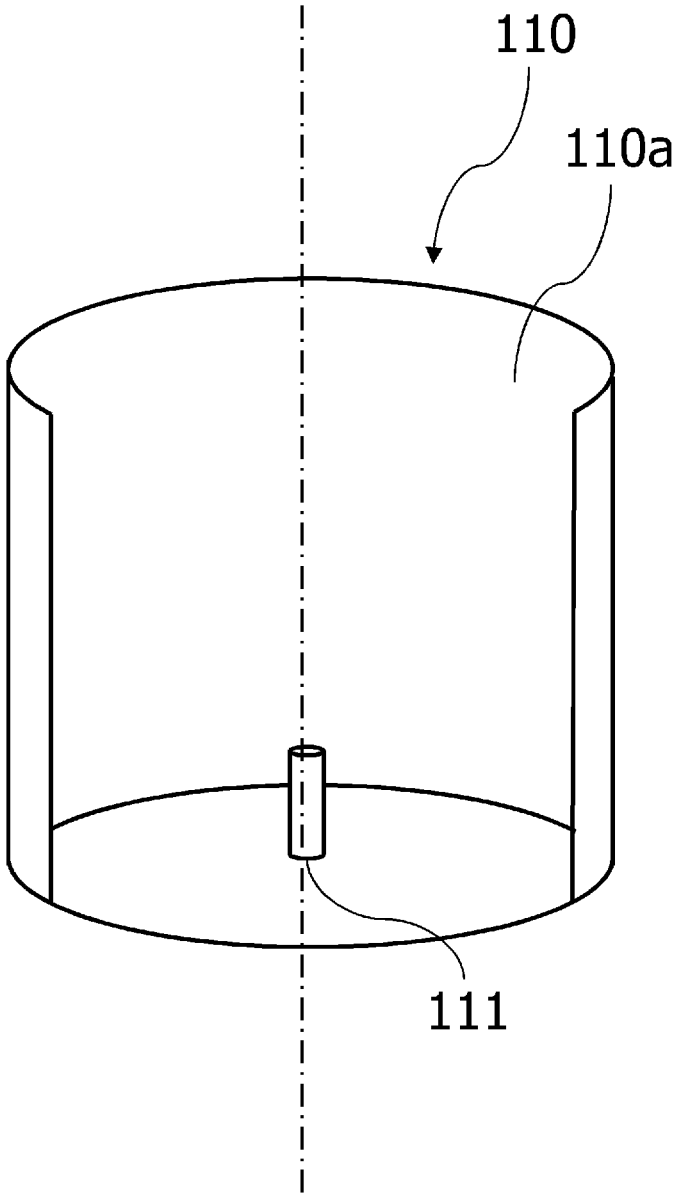
FIG. 9 is a schematic view showing a processing chamber of the surface modification device used in the embodiment.
Figure 10A:
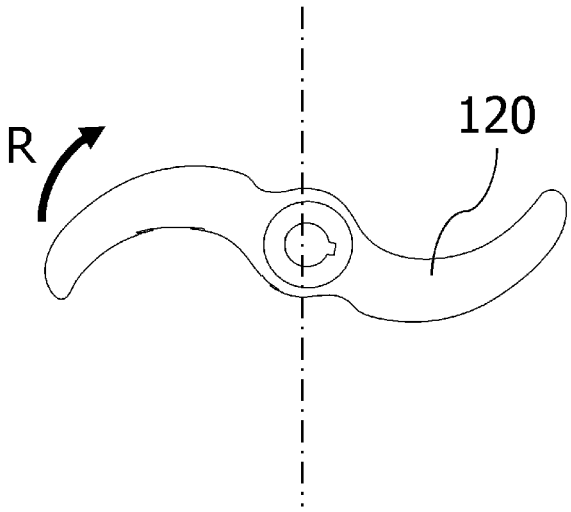
FIGS. 10A and 10B are schematic views showing a stirring blade of the surface modification device used in the embodiment.
Figure 10B:
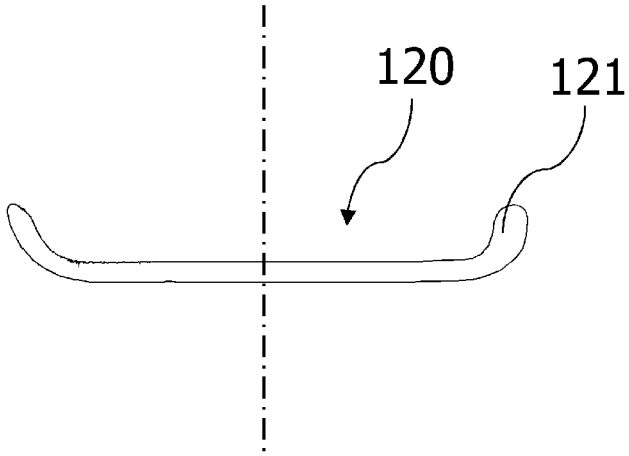
Figure 11A:
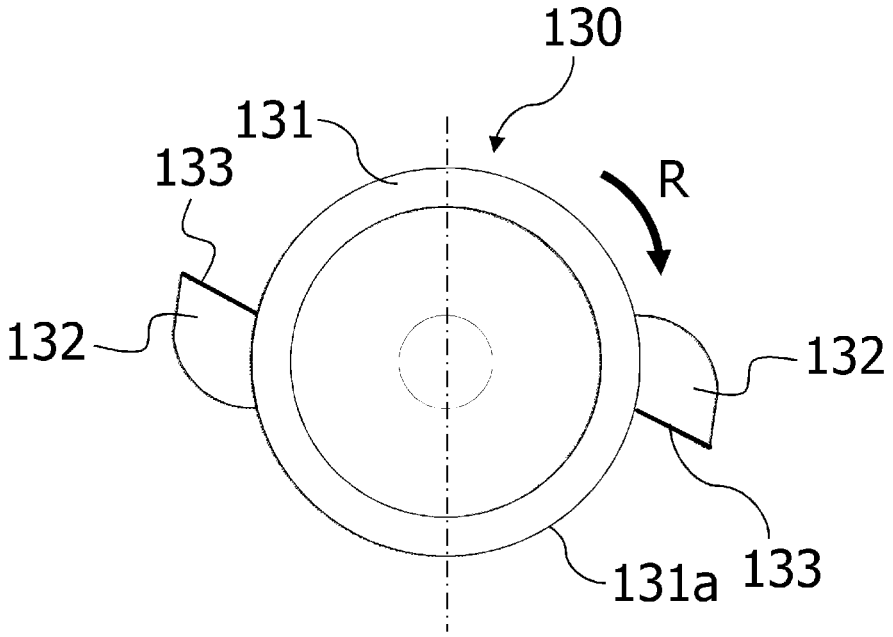
FIGS. 11A and 11B are schematic views showing a rotating member of the surface modification device used in the embodiment.
Figure 11B:
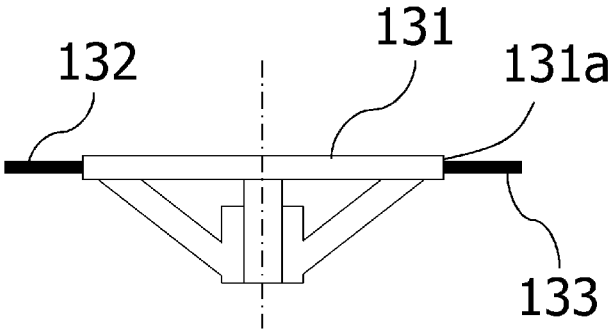
Figure 12B:
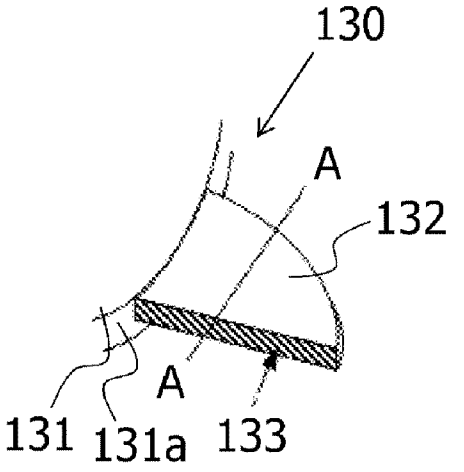
FIGS. 12A, 12B, and 12C are schematic views showing a rotating member of the surface modification device used in the embodiment.
Figure 12C:
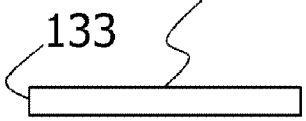
Figure 12A:
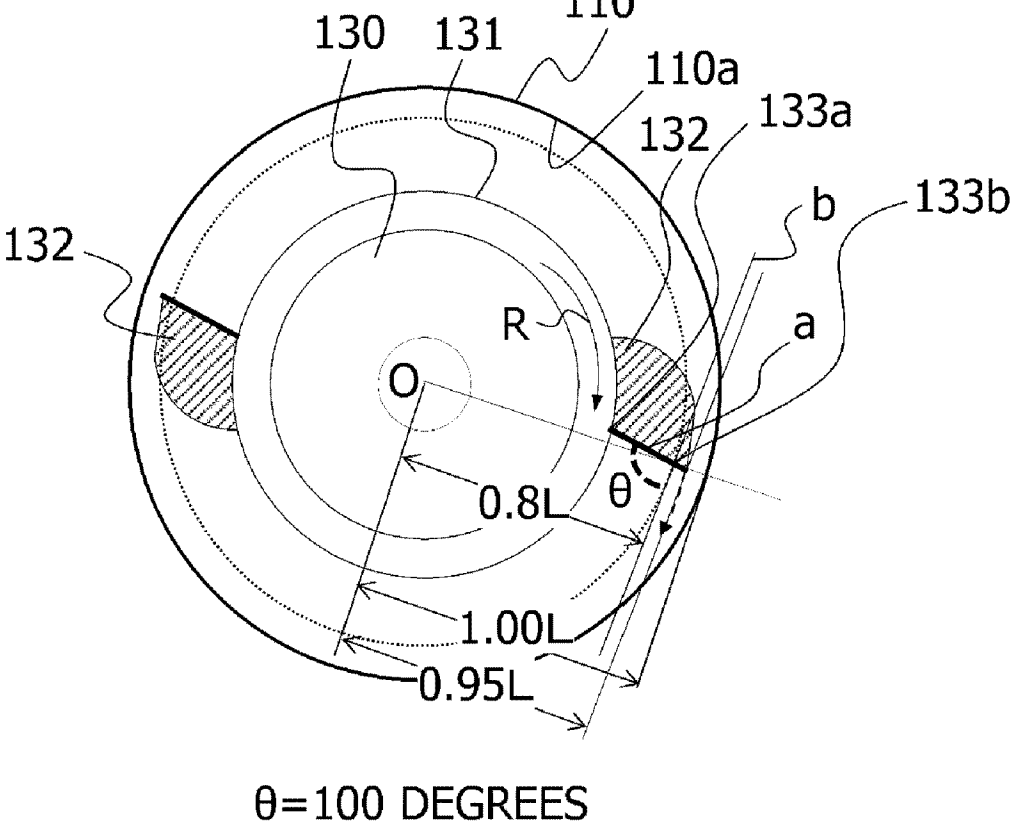

As shown in FIG. 8, the toner processing device 101 includes a processing chamber (processing tank) 110, a stirring blade 120 as a lifting member, a rotating body 130, a drive motor 150, and a control unit 160. In the processing chamber 110, a workpiece containing toner particles and an external additive is stored. The stirring blade 120 is rotatably provided at the bottom of the processing chamber 110 and below the rotating body 130 in the processing chamber. The rotating body 130 is rotatably provided above the stirring blade 120. FIG. 9 shows a schematic view of the processing chamber 110. FIG. 9 shows a state in which an inner peripheral surface (inner wall) 110*a* of the processing chamber 110 is partially cut for convenience of explanation. The processing chamber 110 is a cylindrical container having a substantially flat bottom, and includes a drive shaft 111 for attaching the stirring blade 120 and the rotating body 130 to the substantially center of the bottom. FIGS. 10A and 10B are schematic views of the stirring blade 120 as a lifting member (the top view in FIG. 10A and the side view in FIG. 10B). When the stirring blade 120 rotates, a workpiece containing toner particles and an external additive can be lifted in the processing chamber 110. The stirring blade 120 has a blade part 121 that extends from the rotation center to the outside (radially outward (outer diameter direction), outer diameter side), and the tip of the blade part 121 has a flip-up shape so that the workpiece is lifted. The stirring blade 120 is fixed to the drive shaft 111 at the bottom of the processing chamber 110 and rotates clockwise (arrow R direction) when viewed from the above (in the state shown in FIG. 10A). When the stirring blade 120 rotates, the workpiece rises while being rotated in the same direction as the stirring blade 120 in the processing chamber 110 and is eventually lowered due to gravity. In this manner, the workpiece is uniformly mixed. FIGS. 11A, 11B, 12A, 12B and 12C show schematic views of the rotating member 130. FIG. 11A is a top view of the rotating member 130 and FIG. 11B is a side view thereof. FIG. 12A is a top view showing the rotating member 130 provided in the processing chamber 110, FIG. 12B is a perspective view showing main parts of the rotating member 130, and FIG. 12C is a diagram showing the cross section taken along the line A-A in FIG. 12B. The rotating body 130 is positioned above the stirring blade 120 in the processing chamber 110 and fixed to the same drive shaft 111 for the stirring blade 120, and rotates in the same direction (arrow R direction) as the stirring blade 120. The rotating body 130 includes a rotating body main body 131 and a processing unit 132 having a processing surface 133 that collides with a workpiece according to rotation of the rotating body 130 and processes the workpiece. The processing surface 133 extends from an outer peripheral surface 131*a* of the rotating body main body 131 in the outer diameter direction and is formed such that a region of the processing surface 133 away from the rotating body main body 131 is positioned downstream in the rotation direction of the rotating body 130 from a region closer to the rotating body main body 131 than the region. That is, in FIG. 12A, the processing surface 133 is disposed so that it is inclined in the rotation direction R of the rotating body 130 with respect to the radial direction of the rotating body 130. When the rotating body 130 rotates, the workpiece collides with the processing surface 133, the external additive aggregate is deagglomerated.

External addition conditions and fixing rates of the toner (B) of the comparative example are shown below. Here, a method of measuring an fixing rate of the toner (B) of the comparative example was the same as the measurement method described in the present embodiment.

TABLE 2

External addition conditions and fixing rates of toner (B) of comparative example

| | First-step external addition conditions | | | Second-step external addition conditions | | | |
|---|---|---|---|---|---|---|---|
| Toner | Device | Peripheral velocity (m/s) | Time (sec) | Device | Peripheral velocity (m/s) | Time (sec) | Fixing rate (%) |
| Toner (B) of comparative example | Surface modification device | 40 | 200 | Surface modification device | 20 | 30 | 60 |
| | | 40 | 200 | | 30 | 30 | 70 |
| | | 40 | 200 | | 40 | 40 | 80 |
| | | 40 | 200 | | 40 | 80 | 90 |

The process cartridge 7 shown in FIG. 2 in which a setting angle θ was set to 20° and a penetration amount δ was changed from 0.60 mm to 1.50 mm in increments of 0.1 mm and from 1.50 mm to 1.60 mm in increments of 0.02 mm was prepared and filled with the toner (A) of the present embodiment.

The prepared process cartridge 7 was used to form images of 10000 sheets at a print percentage of 1% in the image forming apparatus shown in FIG. 1 under a low temperature and low humidity environment (15° C./10% Rh).

A photosensitive member driving torque before printing and after 10000 sheets were printed was measured using a torque measuring device to which the process cartridge 7 can be attached and which can drive the photosensitive drum 1 to rotate, and thus an amount of increase in the photosensitive member driving torque before and after printing was measured.

Determination Criteria

The image forming apparatus 100 in the present embodiment allows a driving torque variation range of the photosensitive drum 1 in the single process cartridge 7 from −100% to +120% with respect to a new process cartridge 7.

This is because, when a driving torque of the photosensitive drum 1 (hereinafter referred to as a photosensitive member driving torque) exceeds 120% with respect to a new target, it exceeds an amount of power necessary for the image forming apparatus and the entire device cannot be driven.

Therefore, in this experiment, determination is performed based on whether a rate of increase in the photosensitive member driving torque before and after printing exceeds 120% (exceed: Bad, not exceed: Good). Table 3 shows determination results of a rate of increase in the photosensitive member driving torque before and after printing of the toner (A) of the present embodiment.

In addition, Table 4 shows determination results of a rate of increase in the photosensitive member driving torque before and after printing of the toner (B) of the comparative example. In addition, a graph in which the horizontal axis represents the fixing rate α (%) of the toner (A) of the present embodiment and the vertical axis represents the maximum value of the penetration amount δ (mm) at which a rate of increase in the photosensitive member driving torque with respect to each fixing rate α (%) does not exceed 120% is created and shown in FIG. 6.

TABLE 3

Determination results of toner (A) of the present embodiment

| Fixing rate α | Penetration amount δ 0.60 mm | 0.70 mm | 0.80 mm | 0.90 mm | 1.00 mm |
|---|---|---|---|---|---|
| 95.0% | Good | Good | Good | Good | Good |
| 96.0% | Good | Good | Good | Good | Good |
| 97.0% | Good | Good | Good | Good | Good |

| Fixing rate α | Penetration amount δ 1.10 mm | 1.20 mm | 1.30 mm | 1.40 mm | 1.50 mm |
|---|---|---|---|---|---|
| 95.0% | Good | Good | Good | Good | Good |
| 96.0% | Good | Good | Good | Good | Good |
| 97.0% | Good | Good | Good | Good | Good |

| Fixing rate α | Penetration amount δ 1.52 mm | 1.54 mm | 1.56 mm | 1.58 mm | 1.60 mm |
|---|---|---|---|---|---|
| 95.0% | Bad | Bad | Bad | Bad | Bad |
| 96.0% | Good | Bad | Bad | Bad | Bad |
| 97.0% | Good | Good | Bad | Bad | Bad |

TABLE 4

Determination results of toner (B) of comparative example

| Fixing rate α | Penetration amount δ 0.6 mm | 0.8 mm | 1.0 mm | 1.2 mm | 1.4 mm | 1.6 mm |
|---|---|---|---|---|---|---|
| 60% | Bad | Bad | Bad | Bad | Bad | Bad |
| 70% | Bad | Bad | Bad | Bad | Bad | Bad |
| 80% | Bad | Bad | Bad | Bad | Bad | Bad |
| 90% | Bad | Bad | Bad | Bad | Bad | Bad |

Figure 6:
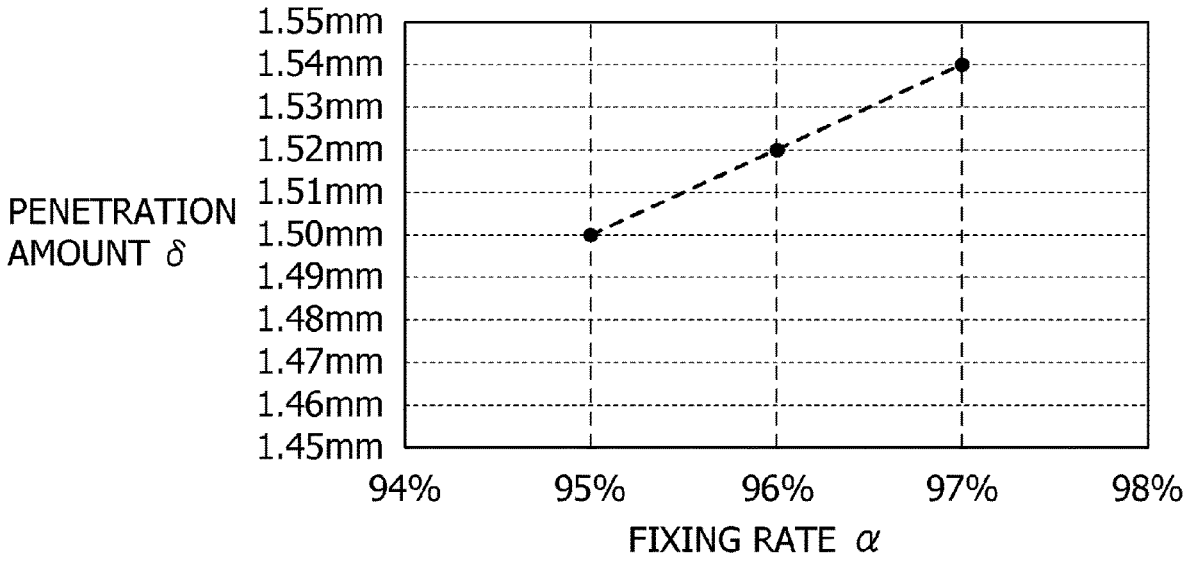
FIG. 6 is a graph showing the relationship between a fixing rate and a penetration amount in the embodiment.

As shown in Table 3, Table 4 and FIG. 6, it was found that, when the toner (A) of the present embodiment was used, if the fixing rate α (%) was higher, the photosensitive member driving torque did not exceed 120% which is an allowable range of a rate of increase even when the penetration amount δ (mm) was higher. In addition, the relationship between the fixing rate α (%) and the penetration amount δ (mm) at that time was $\delta \leq 0.02\times\alpha-0.4$.

Based on these experiment results, it was found that, when the toner (A) of the present embodiment was used and the relationship between the fixing rate α (%) and the penetration amount δ (mm) was $\delta \leq 0.02\times\alpha-0.4$, it was possible to maintain a torque reduction effect of the photosensitive drum 1.

As described above, the toner stored in the process cartridge of the present embodiment is a toner including a toner particle and an organosilicon polymer having a structure represented by Formula (1) covering the surface of the toner particles. Thus, when the fixing rate (%) of the organosilicon polymer having a structure represented by Formula (1) covering the surface of the toner particles with respect to toner particles in such a toner is set as a, and the penetration amount (mm) of a plate-shaped elastic portion with respect to a photosensitive member in which multiple grooves that extend in the circumferential direction on the peripheral surface and are arranged in the longitudinal direction is set as δ, the relationship of $\delta \leq 0.02\times\alpha-0.4$ is established in this configuration. In such a configuration, it is possible to provide a process cartridge and an image forming apparatus which can realize a low torque during long-term use and reduce power consumption.

In the toner, the fixing rate of the organosilicon polymer having a structure represented by the following Formula (1) covering the surface of the toner particles with respect to toner particles in the toner (A) of the present embodiment is preferably at least 30% and not more than 100%, more preferably at least 60% and not more than 100%, still more preferably at least 80% and not more than 100%, and particularly preferably at least 90% and not more than 100%.

Here, in a preferable aspect of the toner, inorganic fine particles are not used as an external additive.

Embodiment 2

The inventors of this application found that the following points were important to realize a low torque during long-term use in a cleaning device included in the process cartridge. That is, particles having low friction were inserted into a cleaning nip and kept therein by applying a sufficient pressure.

That is, when the toner particle includes fine particles containing a specific organosilicon polymer on the surface, since the surface free energy can be reduced, low friction can be exhibited.

The fine particles having low friction can keep grooves formed on the peripheral surface of the photosensitive drum 1, and it is possible to keep a contact area between the photosensitive drum 1 and the cleaning blade 8 small even during long-term use. Thereby, it is possible to realize a low torque during long-term use and reduce power consumption.

Here, in Embodiment 2, parts different from those in Embodiment 1 will be described in detail. Unless otherwise specified in the following description, materials, shapes, steps, and the like are the same as those in Embodiment 1. In addition, components of Embodiment 2 corresponding to those of Embodiment 1 are denoted with the same reference numerals and detailed descriptions may be omitted.

Toner

A toner form of Embodiment 2 is a toner including toner particles (a toner particle) and fine particles (a fine particle) containing an organosilicon polymer having a structure represented by the following Formula (1) present on the surface of the toner particles.

$$R—SiO_{3/2} \quad (1)$$

R represents a hydrocarbon group having at least 1 and not more than 6 carbon atoms. In addition, R is preferably an aliphatic hydrocarbon group or phenyl group having at least 1 and not more than 5 carbon atoms, and more preferably an aliphatic hydrocarbon group having at least 1 and not more than 3 carbon atoms. Preferable examples of an aliphatic hydrocarbon group having at least 1 and not more than 3 carbon atoms include a methyl group, an ethyl group, a propyl group, and a vinyl group.

In addition, the fixing rate of the fine particles is preferably at least 30% and not more than 90%.

Fine Particles Containing Organosilicon Polymers

Fine particles containing organosilicon polymers are preferably fine particles containing a polyalkylsilsesquioxane obtained by dehydration condensation of alkyltrialkoxysilane and more preferably polyalkylsilsesquioxane fine particles.

Here, the polyalkylsilsesquioxane is a network type polymer having a structure of R—$SiO_{3/2}$ (R represents an alkyl group having at least 1 and not more than 6 carbon atoms) obtained by hydrolyzing a trifunctional silane.

Examples of alkyltrialkoxysilanes include methyltrimethoxysilane, methyltriethoxysilane, methyltriisopropoxysilane, ethyltrimethoxysilane, n-propyltriethoxysilane, n-butyltrimethoxysilane, isobutyltrimethoxysilane, isobutyltriethoxysilane, n-hexylmethoxysilane, n-hexyltriethoxysilane. These may be used alone or two or more types thereof may be used in combination.

Method of Producing Fine Particles Containing Organosilicon Polymers 200.0 g of water and 0.1 g of acetic acid as a catalyst were put into a 2,000 mL flask and stirred at 30° C. Here, 100.0 g of methyltrimethoxysilane was added thereto and the mixture was stirred for 2 hours. This was referred to as a step A.

150 g of water, 200.0 g of methanol, and 5 g of sodium hydroxide were put into a 500 mL flask, and stirred at 30° C. for 5 minutes to produce an alkaline aqueous catalyst. This alkaline aqueous catalyst was put into the 2,000 mL flask in the step A. Then, stirring was performed for 10 minutes. This was referred to as a step B.

2,500 g of water was put into a 5,000 mL flask, and while stirring at 35° C., the entire amount of the aqueous solution obtained in the step B was put thereinto. Then, stirring continued for 8 hours, and a dispersion solution containing polymethylsilsesquioxane fine particles was obtained. This was referred to as a step C.

The dispersion solution obtained in the step C was suctioned and filtered and a polymethylsilsesquioxane fine particle cake was formed. In addition, washing with methanol was performed twice. Then, drying was performed at 40° C. for 24 hours under a reduced pressure, and thereby white fine particles were obtained. Then, the white fine particles were sieved by an air classifier and the particle diameter thereof was adjusted. Thereby, polymethylsilsesquioxane fine particles (A) were obtained. The number-average particle diameter of the polymethylsilsesquioxane fine particles (A) was 102 nm.

Method of Measuring Number-Average Particle Diameter of Fine Particles Containing Organosilicon Polymers The number-average particle diameter of the fine particles was calculated from an image of fine particles obtained by performing enlargement at a magnitude of 100000 using a field emission scanning electron microscope (FE-SEM) (S-4800, commercially available from Hitachi High-Technologies Corporation).

First, a solution in which fine particles were suspended in methanol so that the concentration was about 0.5 mass % and dispersed for 1 minute in a homogenizer (with an output of 20 W) was prepared. Then, the solution was added dropwise to a pedestal for observation and dried by air. This was subjected to platinum deposition for 30 seconds and an image enlarged at a magnification of 100000 was obtained using the FE-SEM. Next, the obtained image was printed, but at that time, a plurality of images (100 or more) to be measured was output. 100 pieces were selected randomly from these printed matters and the long diameter was measured using a caliper. The arithmetic mean value of long diameters of the 100 pieces was set as the number-average particle diameter (unit: nm).

Production Example of Toner 400 parts by mass of deionized water and 450 parts by mass of a 0.1 M-$Na_3PO_4$ aqueous solution were put into a 20 L reaction container, and heated to 60° C., and stirring was then performed at 6,000 rpm using a TK Homomixer (commercially available from Tokushu Kika Kogyo Co., Ltd.). 68 parts by mass of a 1.0 M-$CaCl_2$ aqueous solution was added thereto and an aqueous medium containing calcium phosphate was obtained.

Here,

| | |
|---|---|
| Styrene | 75 parts by mass |
| n-Butyl acrylate | 25 parts by mass |
| C. I. Pigment Blue 15:3 | 5 parts by mass |
| Polyester resin (Weight-average molecular weight = 12,500, acid value = 5.5 mgKOH/g) | 5 parts by mass |
| Dialkyl salicylic acid aluminum compound | 1 part by mass |
| Hydrocarbon wax (Endothermic peak = 80° C., half width = 8, weight-average molecular weight = 7 50) | 3 parts by mass |
| Ester wax (Endothermic peak = 67° C., half width = 4, weight-average molecular weight = 690) | 9 parts by mass |
| Divinylbenzene | 0.05 parts by mass |

The formulation was put into a 5 L container and uniformly dissolved and dispersed while heating to 60° C. using a TK Homomixer (commercially available from Tokushu Kika Kogyo Co., Ltd.) at 5,000 rpm. 3.5 parts by mass of a polymerization initiator 2,2'-azobis (2,4-dimethylvaleronitrile) was dissolved therein and thereby a polymerizable monomer composition was prepared. The polymerizable monomer composition was added to the aqueous medium, and stirring was performed at 70° C. under a $N_2$ atmosphere at 10,000 rpm using a TK Homomixer, and polymerizable monomer composition droplets were granulated.

Then, when the polymerization conversion rate of the polymerizable vinyl monomer reached 90% while performing stirring using a paddle stirring blade, a 0.1 mol/L sodium hydroxide aqueous solution was added so that the pH of the aqueous dispersion medium was adjusted to 8.

In addition, the temperature was raised to 80° C. at a heating rate of 40° C./hr and the reaction was caused for 4 hours.

After the polymerization reaction was completed, residual monomers were distilled off under a reduced pressure. After cooling, hydrochloric acid was added so that the pH was adjusted to 1.4, the mixture was stirred for 3 hours, and thereby calcium phosphate was dissolved.

After filtration and washing with water, drying was performed at 40° C. for 48 hours, and fine powder and coarse powder were removed by air classification, and thereby toner particles (A) were obtained. The weight-average particle diameter (D4) of the toner particles A was 7.0 μm.

2.0 parts by mass of polymethylsilsesquioxane fine particles (A) were externally added to 100 parts by mass of the toner particles according to a method to be described below, and thereby a toner (A2) of the present embodiment was obtained.

Method of Measuring Weight-Average Particle Diameter D4 of Toner Particles

The weight-average particle diameter (D4) of the toner particles is calculated as follows. Regarding a measuring device, a precision particle size distribution measuring device "Coulter Counter Multisizer 3" (registered trademark, commercially available from Beckman Coulter, Inc.) having an aperture tube of 100 μm using a pore electrical resistance method is used. For measurement condition setting and measurement data analysis, bundled dedicated software "commercially available from Beckman Coulter, Inc. Multisizer 3 Version 3.51" (commercially available from Beckman Coulter, Inc.) is used. Here, the measurement is performed with 25000 effective measurement channels.

Regarding an electrolyte aqueous solution used for measurement, "ISOTON II" (commercially available from Beckman Coulter, Inc.) obtained by dissolving special grade sodium chloride in deionized water so that the concentration is about 1 mass % is used.

Here, before measurement and analysis are performed, the dedicated software is set as follows.

On the screen "Change standard measurement method (SOMME)" in the dedicated software, the total count number in the control mode is set to 50000 particles, the number of measurements is set to 1, and the Kd value is set to a value obtained using "standard particles 10.0 μm" (commercially available from Beckman Coulter, Inc.). When "the threshold value/noise level measurement button" is pressed, the threshold value and the noise level are automatically set. In addition, the current is set to 1,600 μA, the gain is set to 2, the electrolyte solution is set to ISOTON II, and "flush aperture tube after measurement" is checked.

On the screen "conversion setting from pulse to particle diameter" in the dedicated software, the bin interval is set to a logarithmic particle diameter, the particle diameter bin is set to a 256 particle diameter bin, and the particle diameter range is set to 2 μm to 60 μm.

A specific measurement method is as follows.

(1) About 200 mL of the electrolyte aqueous solution is put into a 250 mL glass round-bottom beaker dedicated for the Multisizer 3, the beaker is set on a sample stand, and stirring is performed using a stirrer rod counterclockwise at 24 revolutions/second. Then, dust and bubbles in the aperture tube are removed according to the function "flush aperture tube" in the dedicated software.

(2) About 30 mL of the electrolyte aqueous solution is put into a 100 mL glass flat-bottomed beaker. About 0.3 ml of a diluted solution obtained by diluting "Contaminone N" (a 10 mass % aqueous solution of a neutral detergent for washing a precision measurement instrument which includes a nonionic surfactant, an anionic surfactant, and an organic builder and has pH 7, commercially available from Wako Pure Chemical Industries, Ltd.) in deionized water by a factor of about 3 (based on the mass) is added thereto as a dispersant.

(3) An ultrasonic disperser "Ultrasonic Dispersion System Tetra 150" (commercially available from Nikkaki Bios Co., Ltd.) with an electrical output of 120 W into which two oscillators with an oscillation frequency of 50 kHz and of which phases are shifted by 180 degrees are built is prepared. About 3.3 L of deionized water is put into a water tank of the ultrasonic disperser, and about 2 mL of Contaminone N is added to the water tank.

(4) The beaker in the above (2) is set in a beaker fixing hole of the ultrasonic disperser and the ultrasonic disperser is operated. Then, the height position of the beaker is adjusted so that the resonance state of the liquid level of the electrolyte aqueous solution in the beaker is maximized.

(5) While ultrasound is emitted to the electrolyte aqueous solution in the beaker in the above (4), small amounts of about 10 mg of the toner particles are added to and dispersed in the electrolyte aqueous solution. Then, an ultrasonic dispersion treatment additionally continues for 60 seconds. Here, in ultrasonic dispersion, the temperature of water in the water tank is appropriately adjusted to at least 10° C. and not more than 40° C.

(6) The electrolyte aqueous solution in the above (5) in which toner particles are dispersed is added dropwise to the round-bottom beaker in the above (1) placed in the sample stand using a pipette, and the measurement concentration is adjusted to about 5%. Then, measurement is performed until the number of measured particles is 50000.

(7) Measurement data is analyzed using the dedicated software bundled in the device and the weight-average particle diameter (D4) is calculated. Here, "average diameter" on the screen "analysis/volume statistical value (arithmetic mean)" when graph/volume % is set in the dedicated software is set to weight-average particle diameter (D4).

Method of Measuring Adhesion Rate of Fine Particles with Respect to Surface of Toner Particles A method of measuring a fixing rate (%) of the polymethylsilsesquioxane fine particles (A) or silica fine particles is as follows.

160 g of sucrose (commercially available from Kishida Chemical Co., Ltd.) was added to 100 mL of deionized water, and dissolved in a water bath, and thereby a sucrose concentrated solution was prepared. 31 g of the sucrose concentrated solution and 6 mL of Contaminone N (a 10 mass % aqueous solution of a neutral detergent for washing a precision measurement instrument which included a nonionic surfactant, an anionic surfactant, and an organic builder and had pH 7, commercially available from Wako Pure Chemical Industries, Ltd.) were put into a centrifuge tube (with a volume of 50 mL) to produce a dispersion solution. 1.0 g of the toner was added to the dispersion solution, and the toner mass was disintegrated using a spatula or the like.

The centrifuge tube was shaken in a shaker at 350 spm (strokes per min) for 20 minutes. After shaking, the solution was moved to a glass tube for a swing rotor (with a volume of 50 mL), and separated in a centrifuge (H-9R commercially available from Kokusan Co., Ltd.) under conditions of 3,500 rpm for 30 minutes. It was visually confirmed that the toner and the aqueous solution were sufficiently separated, and the toner separated in the top layer was collected using a spatula or the like. The aqueous solution containing the collected toner was filtered in a filtration machine under a reduced pressure and drying was then performed in a dryer for 1 hour or longer. The dried product was deagglomerated using a spatula, and an amount of silicon was measured using X-ray fluorescence. A fixing rate (%) of fine particles with respect to the surface of the toner particles was calculated based on the ratio of amounts of elements to be measured between the toner after washing and the toner before washing.

The X-ray fluorescence of elements was measured according to JIS K 0119-1969, and details are as follows.

Regarding a measuring device, a wavelength dispersive X-ray fluorescence analyzing device "Axios" (commercially available from PANalytical), and bundled dedicated software "SuperQ ver. 4.0F" (commercially available from PANalytical) for measurement condition setting and measurement data analysis were used. Here, Rh was used as an X-ray tube anode, the measurement atmosphere was a vacuum, the measurement diameter (collimator mask diameter) was 10 mm, and the measurement time was 10 seconds. In addition, when a light element was measured, the X-ray fluorescence was detected by a proportional counter (PC), and when a heavy element was measured, the X-ray fluorescence was detected by a scintillation counter (SC).

Regarding a measurement sample, pellets obtained by putting about 1 g of the toner after washing or the toner before washing into an exclusive aluminum ring for pressing with a diameter of 10 mm and flattening it, and performing pressing at 20 MPa for 60 seconds using a tablet molding compressor "BRE-32" (commercially available from Maekawa Testing Machine MFG. Co., Ltd.), and performing molding to a thickness of about 2 mm were used.

Measurement was performed under the above conditions, an element was identified based on the obtained X-ray peak position, and its concentration was calculated from a counting rate (unit: cps) which was the number of X-ray photons per unit time.

In a quantitative method in the toner, for example, regarding an amount of silicon, for example, 0.5 parts by mass of silica ($SiO_2$) fine powder was added with respect to 100 parts by mass of toner particles, and the mixture was sufficiently mixed using a coffee mill. In the same manner, 2.0 parts by mass and 5.0 parts by mass of silica fine powder were mixed together with toner particles, and these were used as calibration curve samples.

Regarding the samples, using a tablet molding compressor, calibration curve sample pellets were produced as described above, and the counting rate (unit: cps) of Si-Kα rays observed at a diffraction angle (2θ)=109.08° when PET was used as a dispersive crystal was measured. In this case, the acceleration voltage and the current value of an X-ray generation device were 24 kV and 100 mA. A linear function calibration curve in which the vertical axis represented the obtained X-ray counting rate and the horizontal axis represented an amount of $SiO_2$ added in each calibration curve sample was obtained.

Next, the toner to be analyzed was formed into pellets as described above using a tablet molding compressor, and the counting rate of Si-Kα rays was measured. Then, the content of silicon in the toner was obtained from the above calibration curve. The ratio of the amount of silicon in the toner after washing to the amount of silicon in the toner before washing calculated by the above method was obtained and used as a fixing rate (%).

External Addition Method

The toner (A2) of the present embodiment was obtained by externally adding polymethylsilsesquioxane fine particles (A) to toner particles (A) according to the method described in the example in Japanese Patent Application Publication No. 2016-38591.

That is, with respect to 100 parts by mass of the toner particles (A), 2.0 parts by mass of polymethylsilsesquioxane fine particles (A) were subjected to a two-step treatment under conditions shown in the following Table 5 using a toner processing device (surface modification device) 101 shown in FIG. 8 to FIG. 12. Then, coarse particles were removed using a 200 mesh sieve, and thereby a toner (A2) of the present embodiment was obtained.

As shown in FIG. 8, the toner processing device 101 includes a processing chamber (processing tank) 110, a stirring blade 120 as a lifting member, a rotating body 130, a drive motor 150, and a control unit 160. In the processing chamber 110, a workpiece containing toner particles and an external additive is stored. The stirring blade 120 is rotatably provided at the bottom of the processing chamber 110 and below the rotating body 130 in the processing chamber. The rotating body 130 is rotatably provided above the stirring blade 120. FIG. 9 shows a schematic view of the processing chamber 110. FIG. 9 shows a state in which an inner peripheral surface (inner wall) 110*a* of the processing chamber 110 is partially cut for convenience of explanation. The processing chamber 110 is a cylindrical container having a substantially flat bottom, and includes a drive shaft 111 for attaching the stirring blade 120 and the rotating body 130 to the substantially center of the bottom. FIGS. 10A and 10B are schematic views of the stirring blade 120 as a lifting member (the top view in FIG. 10A and the side view in FIG. 10B). When the stirring blade 120 rotates, a workpiece containing toner particles and an external additive can be lifted in the processing chamber 110. The stirring blade 120 has a blade part 121 that extends from the rotation center to the outside (radially outward (outer diameter direction), outer diameter side), and the tip of the blade part 121 has a flip-up shape so that the workpiece is lifted. The stirring blade 120 is fixed to the drive shaft 111 at the bottom of the processing chamber 110 and rotates clockwise (arrow R direction) when viewed from the above (in the state shown in FIG. 10A). When the stirring blade 120 rotates, the workpiece rises while being rotated in the same direction as the stirring blade 120 in the processing chamber 110 and is eventually lowered due to gravity. In this manner, the workpiece is uniformly mixed. FIGS. 11A, 11B, 12A, 12B and 12C show schematic views of the rotating member 130. FIG. 11A is a top view of the rotating member 130 and FIG. 11B is a side view thereof. FIG. 12A is a top view showing the rotating member 130 provided in the processing chamber 110, FIG. 12B is a perspective view showing main parts of the rotating member 130, and FIG. 12C is a diagram showing the cross section taken along the line A-A in FIG. 12B. The rotating body 130 is positioned above the stirring blade 120 in the processing chamber 110 and fixed to the same drive shaft 111 for the stirring blade 120, and rotates in the same direction (arrow R direction) as the stirring blade 120. The rotating body 130 includes a rotating body main body 131 and a processing unit 132 having a processing surface 133 that collides with a workpiece according to rotation of the rotating body 130 and processes the workpiece. The processing surface 133 extends from an outer peripheral surface 131*a* of the rotating body main body 131 in the outer diameter direction and is formed such that a region of the processing surface 133 away from the rotating body main body 131 is positioned downstream in the rotation direction of the rotating body 130 from a region closer to the rotating body main body 131 than the region. That is, in FIG. 12A, the processing surface 133 is disposed so that it is inclined in the rotation direction R of the rotating body 130 with respect to the radial direction of the rotating body 130. When the rotating body 130 rotates, the workpiece collides with the processing surface 133, the external additive aggregate is deagglomerated.

The fixing rate of the toner (A2) of the present embodiment that can be obtained by this method was adjusted by changing a wing tip peripheral velocity (described as a "peripheral velocity" in the following Table 5) and time during the two-step treatment. The fixing rate was preferably at least 30% and not more than 90%. When the fixing rate was set to be within the above range, opportunities for toner particles (A) to come in contact with each other were appropriate, and thus a toner attachment force was unlikely to change, and the change in charging performance was reduced. Here, in the above external addition method, it was difficult to obtain a fixing rate of higher than 90%.

Experiment

The toner (A2) of the present embodiment produced so that the fixing rate obtained according to the measurement method of the present embodiment was 60% to 90% in increments of 10% was prepared. In addition, a toner (B2) of a comparative example in which inorganic fine particles (inorganic silicon fine particles) as an external additive were externally added to toner particles so that the same fixing rate was obtained was prepared and subjected to the following comparative experiment together with the toner (A2) of the present embodiment.

The toner (B2) of the comparative example was produced using inorganic fine particles produced according to description in Embodiment 5 in Japanese Patent Application Publication No. 2016-38591 according to the above external addition method.

Hereinafter, a method of producing toner particles and inorganic fine particles used in the toner (B2) of the comparative example used in this experiment will be described.

Production of Toner Particle 710 parts by mass of deionized water and 850 parts by mass of a 0.1 mol/L $Na_3PO_4$ aqueous solution were put into a four-neck container and the mixture was kept at 60° C. while stirring at 12,000 rpm using a high speed stirring device TK-homomixer. 68 parts by mass of a 1.0 mol/L-$CaCl_2$ aqueous solution was gradually added thereto to prepare an aqueous dispersion medium containing a fine dispersion stabilizer $Ca_3(PO_4)_2$ with low solubility.

| | |
|---|---|
| Styrene | 122 parts by mass |
| n-Butyl acrylate | 36 parts by mass |
| Copper phthalocyanine pigment (pigment blue 15:3) | 13 parts by mass |
| Low-molecular-weight polystyrene (glass transition point = 55° C., Mw = 3,000, Mn = 1,050) | 40 parts by mass |
| Polyester resin (1) (terephthalic acid-propylene oxide-modified bisphenol A (2 mol adduct) (molar ratio = 51:50), acid value =10 mgKOH/g, glass transition point =70° C., Mw =10500, Mw/Mn = 3.20) | 10 parts by mass |
| Negative charge control agent (3,5-di-tert-butylsalicylic acid aluminum compound) | 0.8 parts by mass |
| Wax (Fischer-Tropsch wax, endothermic main peak temperature = 78° C.) | 15 parts by mass |

The above materials were stirred for 3 hours using an attritor and respective components were dispersed in polymerizable monomers to prepare a monomer mixture. 20.0 parts by mass (toluene solution 50%) of 1,1,3,3-tetramethylbutylperoxy 2-ethylhexanoate as a polymerization initiator was added to the monomer mixture to prepare a polymerizable monomer composition.

The polymerizable monomer composition was added to the aqueous dispersion medium and granulated for 5 minutes while maintaining a rotational speed of the stirrer at 10,000 rpm. Then, a high speed stirring device was replaced with a propeller stirrer, the internal temperature was raised to 70° C., and the reaction was caused for 6 hours while slowly stirring.

Next, the temperature in the container was raised to 80° C. and maintained for 4 hours and then gradually cooled to 30° C. at a cooling rate of 1° C./min to obtain a slurry 1. Dilute hydrochloric acid was put into a container containing the slurry 1 and a dispersion stabilizer was removed. In addition, filtration, washing, and drying were performed to obtain polymer particles (toner particles) having a weight-average particle diameter (D4) of 6.5 μm and an average circularity of 0.980. The true density of toner particles was 1.1 g/cm$^3$.

Producing Inorganic Silicon Fine Particles 590.0 g of methanol, 42.0 g of water, and 48.0 g of 28 mass % ammonia water were put into a 3 L glass reaction container including a stirrer, a dripping funnel, and a thermometer, and mixed. The obtained solution was adjusted to 35° C., and while stirring, addition of 1,100.0 g (7.23 mol) of tetramethoxysilane and 395.0 g of 5.5 mass % ammonia water started at the same time. Tetramethoxysilane was added dropwise over 6 hours and ammonia water was added dropwise over 5 hours. After dropwise addition was completed, additionally, stirring continued for 0.5 hours, hydrolysis was performed, and thereby a methanol-water dispersion solution containing hydrophilic spherical sol-gel silica fine particles was obtained. Next, an ester adapter and a cooling pipe were attached to the glass reaction container, and the dispersion solution was sufficiently dried at 80° C. under a reduced pressure. The obtained silica particles were heated in a thermostatic tank at 400° C. for 10 minutes.

The obtained silica particles were deagglomerated using a pulverizer (commercially available from Hosokawa Micron Corporation).

Then, 500 g of silica particles was put into a polytetrafluoroethylene inner cylinder type stainless steel autoclave with an internal volume of 1000 ml. The inside of the autoclave was purged with nitrogen gas. Then, while rotating a stirring blade bundled in the autoclave at 400 rpm, 0.5 g of HMDS (hexamethyldisilazane) and 0.1 g of water were atomized through a two-fluid nozzle and sprayed uniformly to silica powder. After stirring for 30 minutes, the autoclave was sealed and heated at 220° C. for 2 hours. Subsequently, the system was depressurized while being heated and subjected to a deammonia treatment and sol-gel silica particles (that is, inorganic silicon fine particles, and the number-average particle diameter of primary particles was 80 nm) were obtained.

Hereinafter, external addition conditions and fixing rates of the toner (A2) of the present embodiment and the toner (B2) of the comparative example will be shown. Here, a method of measuring a fixing rate of the toner (B2) of the comparative example was the same as the measurement method described in the present embodiment.

TABLE 5

| External addition condition and fixing rate | | | | | | | |
|---|---|---|---|---|---|---|---|
| | First-step external addition conditions | | | Second-step external addition conditions | | | |
| Toner | Device | Peripheral velocity (m/s) | Time (sec) | Device | Peripheral velocity (m/s) | Time (sec) | Fixing rate (%) |
| Toner(A2) of embodiment | Surface modification device | 40 | 200 | Surface modification device | 20 | 30 | 60 |
| | | 40 | 200 | | 30 | 30 | 70 |
| | | 40 | 200 | | 40 | 40 | 80 |
| | | 40 | 200 | | 40 | 80 | 90 |
| Toner (B2) of comparative example | Surface modification device | 40 | 200 | Surface modification device | 20 | 30 | 60 |
| | | 40 | 200 | | 30 | 30 | 70 |
| | | 40 | 200 | | 40 | 40 | 80 |
| | | 40 | 200 | | 40 | 80 | 90 |

The process cartridge 7 shown in FIG. 2 in which a setting angle θ was set to 20° and a penetration amount δ was changed from 0.6 mm to 1.6 mm in increments of 0.2 mm was prepared and filled with the toner (A2) of the present embodiment and the toner (B2) of the comparative example.

The prepared process cartridge 7 was used to form images of 10000 sheets at a print percentage of 1% in the image forming apparatus shown in FIG. 1 under a low temperature and low humidity environment (15° C./10% Rh).

A driving torque of the photosensitive drum 1 before printing and after 10000 sheets were printed was measured using a torque measuring device to which the process cartridge 7 can be attached and which can drive the photosensitive drum 1 to rotate, and thus an amount of increase in the driving torque of the photosensitive drum 1 before and after printing was measured.

Determination Criteria

The image forming apparatus 100 in the present embodiment allows a driving torque variation range of the photosensitive drum 1 in the single process cartridge 7 from −100% to +120% with respect to a new process cartridge 7. This is because, when a driving torque of the photosensitive drum 1 (hereinafter referred to as a photosensitive member driving torque) exceeds 120% with respect to a new target, it exceeds an amount of power necessary for the image forming apparatus and the entire device cannot be driven. Therefore, in this experiment, determination is performed based on whether a rate of increase in the photosensitive member driving torque before and after printing exceeds 120% (exceed: Bad, not exceed: Good). The following Table 6 shows determination results of a rate of increase in the photosensitive member driving torque before and after printing of the toner (A2) of the present embodiment. In addition, the following Table 7 shows determination results of a rate of increase in the photosensitive member driving torque before and after printing the toner (B2) of the comparative example. In addition, a graph in which the horizontal axis represents the fixing rate α of the toner (A2) of the present embodiment and the vertical axis represents the maximum value of the penetration amount δ at which a rate of increase in the photosensitive member driving torque with respect to each fixing rate α does not exceed 120% is created and shown in FIG. 13.

TABLE 6

| Determination results of toner (A2) of the present embodiment | | | | | | |
|---|---|---|---|---|---|---|
| Fixing | Penetration amount δ | | | | | |
| rate α | 0.6 mm | 0.8 mm | 1.0 mm | 1.2 mm | 1.4 mm | 1.6 mm |
| 60% | Good | Good | Bad | Bad | Bad | Bad |
| 70% | Good | Good | Good | Bad | Bad | Bad |
| 80% | Good | Good | Good | Good | Bad | Bad |
| 90% | Good | Good | Good | Good | Good | Bad |

TABLE 7

| Determination results of toner (B2) of the comparative example | | | | | | |
|---|---|---|---|---|---|---|
| Fixing | Penetration amount δ | | | | | |
| rate α | 0.6 mm | 0.8 mm | 1.0 mm | 1.2 mm | 1.4 mm | 1.6 mm |
| 60% | Bad | Bad | Bad | Bad | Bad | Bad |
| 70% | Bad | Bad | Bad | Bad | Bad | Bad |
| 80% | Bad | Bad | Bad | Bad | Bad | Bad |
| 90% | Bad | Bad | Bad | Bad | Bad | Bad |

Figure 13:
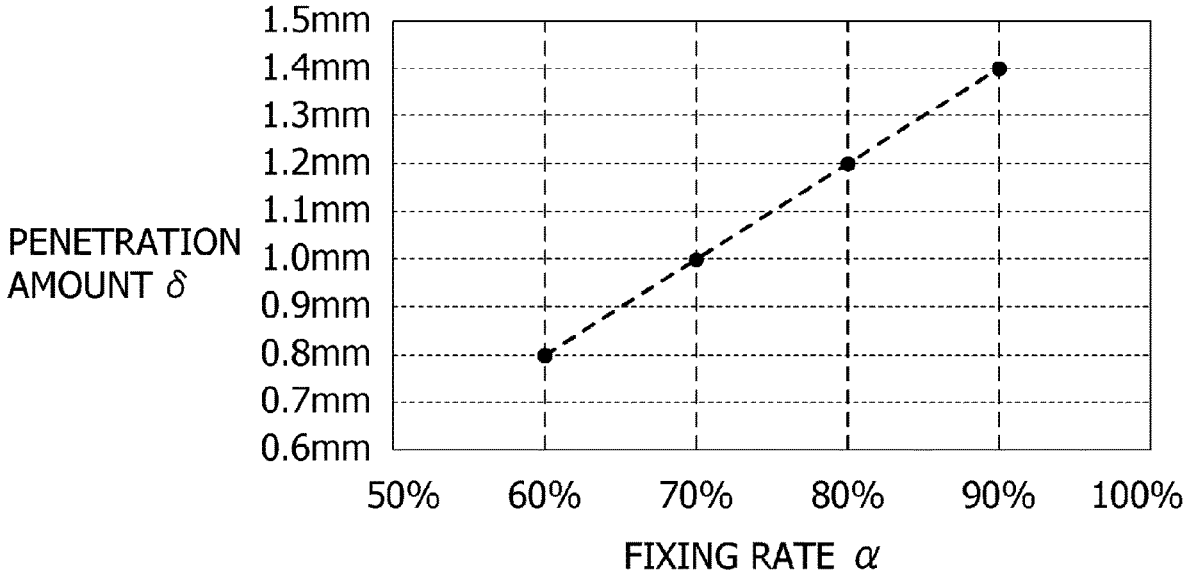
FIG. 13 is a graph showing the relationship between a fixing rate and a penetration amount in Embodiment 2.

As shown in Table 6 and FIG. 13, it was found that, when the toner (A2) of the present embodiment was used, if the fixing rate α was higher, the photosensitive member driving torque did not exceed 120% which is an allowable range of a rate of increase even when the penetration amount δ was higher. In addition, the relationship between the fixing rate α and the penetration amount δ was $\delta \leq 0.02 \times \alpha - 0.4$. In this case, the penetration amount δ was $\delta > 0$, which is a range in which the photosensitive drum 1 and the cleaning blade 8 can come in contact with each other, and the fixing rate α was $\alpha > 0$, which is a range in which fine particles were fixed to toner particles.

On the other hand, as shown in Table 7, it was found that, when the toner (B2) of the comparative example was used, a rate of increase in the photosensitive member driving torque exceeded the allowable range 120% independently of the fixing rate α and the penetration amount δ.

Based on these experiment results, it was found that, when the toner (A2) of the present embodiment was used and the relationship between the fixing rate α and the penetration amount δ was $\delta \leq 0.02 \times \alpha - 0.4$, it was possible to maintain a torque reduction effect of the photosensitive drum 1.

The maintenance of the torque reduction effect in this experiment result was determined according to the wearability and amount of fine particles sent from the developing device 3 to the cleaning device with respect to the photosensitive drum 1. It was possible to maintain the low torque effect as the wearability of fine particles with respect to the photosensitive drum 1 was lower. The polymethylsilsesquioxane fine particles (A) which are fine particles of the toner (A2) of the present embodiment had lower wearability than inorganic silicon fine particles which are fine particles of the toner (B2) of the comparative example.

In addition, as an amount of fine particles that wore the photosensitive drum 1 sent from the developing device 3 to a cleaning device was smaller, the frequency with which the photosensitive drum 1 was worn was lower and it was possible to maintain the low torque effect. As the fixing rate was higher, an amount of fine particles that were not attached to toner particles was smaller, and an amount of fine particles sent to the cleaning device was reduced.

As described above, the toner stored in the process cartridge of the present embodiment is a toner containing a toner particle and a fine particle containing an organosilicon polymer. Thus, when the fixing rate (%) of the fine particle with respect to toner particles in such a toner is set as a, and the penetration amount of a plate-shaped elastic portion with respect to a photosensitive member in which multiple grooves that extend in the circumferential direction on the peripheral surface and are arranged in the longitudinal direction is set as δ (mm), the relationship of $\delta \leq 0.02 \times \alpha - 0.4$ is established in this configuration. In such a configuration, it is possible to provide a process cartridge and an image forming apparatus which can realize a low torque during long-term use and reduce power consumption.

In addition, in a preferable aspect of the toner, inorganic fine particles are not used as an external additive.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-213923, filed on Nov. 14, 2018, and Japanese Patent Application No. 2018-247084, filed on Dec. 28, 2018 which are hereby incorporated by reference herein in their entirety.

What is claimed is:

1. A process cartridge used for an image forming apparatus, comprising:

a rotatable photosensitive member having a peripheral surface on which a latent image is formed;

a developing device configured to supply a developer to the photosensitive member for developing the latent image on the photosensitive member; and a plate-shaped elastic portion that comes in contact with the peripheral surface of the photosensitive member and cleans the peripheral surface, wherein, in the photosensitive member, multiple grooves extend in a circumferential direction on the peripheral surface and are formed to be side by side in a generatrix direction on the peripheral surface, the developer supplied from the developing device to the photosensitive member contains a toner including a toner particle and an organosilicon polymer having a structure represented by a following Formula (1) covering the surface of the toner particle, when a penetration amount of the plate-shaped elastic portion with respect to the photosensitive member is set as δ (mm), and a fixing rate of the organosilicon polymer on the surface of the toner particle is set as a (%), a following Formula (2) is satisfied:

$$R—SiO_{3/2} \quad (1)$$

(R represents a hydrocarbon group having at least 1 and not more than 6 carbon atoms)

$$\delta \leq 0.02 \times \alpha - 0.4 \quad (2), \text{ and}$$

wherein the fixing rate of the organosilicon polymer having a structure represented by the Formula (1) covering the surface of the toner particle is at least 30% and not more than 100%.

2. The process cartridge according to claim 1, wherein, in the toner, an inorganic particle is not used as an external additive.

3. The process cartridge according to claim 1, wherein R represents an alkyl group having at least 1 and not more than 6 carbon atoms.

4. The process cartridge according to claim 1, wherein a width of the grooves in the generatrix direction is within a range of at least 0.5 μm and not more than 40 μm, the number of grooves is at least 20 and not more than 1000 per a length of 1000 μm of the peripheral surface in the generatrix direction, an elastic deformation ratio of the peripheral surface of the photosensitive member is at least 50% and not more than 65%, and a universal hardness value (HU) of the peripheral surface of the photosensitive member is at least 150 N/mm2 and not more than 210 N/mm2.

5. The process cartridge according to claim 4, wherein, with respect to the number of grooves per the length of 1000 μm of the peripheral surface in the generatrix direction, the grooves have a width within a range of at least 0.5 μm and not more than 40 μm, the number of grooves is set as i ($20 \leq i \leq 1000$), and widths of the grooves, which fall into the width within the range of at least 0.5 μm and not more than 40 μm, are set as from W1 to Wi [μm], a following relational expression (a) is satisfied.

6. The process cartridge according to claim 1, wherein a ten-point average surface roughness (Rz) of the peripheral surface of the photosensitive member is at least 0.3 μm and not more than 1.3 μm, and a difference (R max−Rz) between the ten-point average surface roughness (Rz) and a maximum surface roughness (R max) of the peripheral surface is 0.3 μm or less.

7. The process cartridge according to claim 1, further comprising:

a support portion that supports the plate-shaped elastic portion; and a frame which rotatably supports the photosensitive member and to which the support portion is fixed, wherein the plate-shaped elastic portion includes a first end that is fixed to the support portion and a second end as a free end that comes in contact with the peripheral surface, the support portion includes a first end that is fixed to the frame and a second end to which the first end of the plate-shaped elastic portion is fixed, and a direction that extends from the first end of the support portion to the second end of the plate-shaped elastic portion, is opposite to a rotation direction of the photosensitive member, at a portion where the second end of the plate-shaped elastic portion is in contact with the peripheral surface of the photosensitive member.

8. The process cartridge according to claim 1, wherein, in a posture during use, the photosensitive member rotates so that the peripheral surface moves in a direction from an upper side to a lower side in a portion where the plate-shaped elastic portion is in contact with the peripheral surface of the photosensitive member.

9. An image forming apparatus, comprising:

an apparatus main body; and the process cartridge according to claim 1 which is detachable from and attachable to the apparatus main body.

10. A process cartridge used for an image forming apparatus, comprising:

a rotatable photosensitive member having a peripheral surface on which a latent image is formed; and a developing device configured to supply a developer to the photosensitive member for developing the latent image on the photosensitive member; and a plate-shaped elastic portion that comes in contact with the peripheral surface of the photosensitive member and cleans the peripheral surface, wherein, in the photosensitive member, multiple grooves extend in a circumferential direction on the peripheral surface and are formed to be side by side in a generatrix direction on the peripheral surface, the developer supplied from the developing device to the photosensitive member contains a toner including a toner particle and a particle containing an organosilicon polymer having a structure represented by a following Formula (1) present on the surface of the toner particle, and when a penetration amount of the plate-shaped elastic portion with respect to the photosensitive member is set as δ (mm), and a fixing rate of the particle on the surface of the toner particle is set as a (%), a following Formula (2) is satisfied:

$$R—SiO_{3/2} \quad (1)$$

(R represents a hydrocarbon group having at least 1 and not more than 6 carbon atoms)

$$\delta \leq 0.02 \times \alpha - 0.4 \quad (2), \text{ and}$$

wherein the fixing rate of the particle on the surface of the toner particle is at least 30% and not more than 90%.

11. The process cartridge according to claim 10, wherein R represents an alkyl group having at least 1 and not more than 6 carbon atoms.

12. The process cartridge according to claim 10, wherein the particle is a polyalkylsilsesquioxane particle.

13. The process cartridge according to claim 10, wherein, in the toner, an inorganic particle is not used as an external additive.

14. The process cartridge according to claim 10, wherein a width of the grooves in the generatrix direction is within a range of at least 0.5 μm and not more than 40 μm, the number of grooves is at least 20 and not more than 1000 per a length of 1000 μm of the peripheral surface in the generatrix direction, an elastic deformation ratio of the peripheral surface of the photosensitive member is at least 50% and not more than 65%, and a universal hardness value (HU) of the peripheral surface of the photosensitive member is at least 150 N/mm2 and not more than 210 N/mm2.

15. The process cartridge according to claim 14, wherein, with respect to the number of grooves per the length of 1000 μm of the peripheral surface in the generatrix direction, the grooves have a width within a range of at least 0.5 μm and not more than 40 μm, the number of grooves is set as i ($20 \leq i \leq 1000$), and widths of the grooves, which fall into the width within the range of at least 0.5 μm and not more than 40 μm are set as from W1 to Wi [μm], a following relational expression (a) is satisfied.

16. The process cartridge according to claim 10, wherein a ten-point average surface roughness (Rz) of the peripheral surface of the photosensitive member is at least 0.3 μm and not more than 1.3 μm, and a difference (R max−Rz) between the ten-point average surface roughness (Rz) and a maximum surface roughness (R max) of the peripheral surface is 0.3 μm or less.

17. The process cartridge according to claim 10, further comprising:

a support portion that supports the plate-shaped elastic portion; and a frame which rotatably supports the photosensitive member and to which the support portion is fixed, wherein the plate-shaped elastic portion includes a first end that is fixed to the support portion and a second end as a free end that comes in contact with the peripheral surface, the support portion includes a first end that is fixed to the frame and a second end to which the first end of the plate-shaped elastic portion is fixed, and a direction that extends from the first end of the support portion to the second end of the plate-shaped elastic portion, is opposite to a rotation direction of the photosensitive member, at a portion where the second end of the plate-shaped elastic portion is in contact with the peripheral surface of the photosensitive member.

18. The process cartridge according to claim 10, wherein, in a posture during use, the photosensitive member rotates so that the peripheral surface moves in a direction from an upper side to a lower side in a portion where the plate-shaped elastic portion is in contact with the peripheral surface of the photosensitive member.

19. An image forming apparatus, comprising:

an apparatus main body; and the process cartridge according to claim 10 which is detachable from and attachable to the apparatus main body.

* * * * *